299-13 SR
10/27/81 XR 4,296,968

United States Patent [19]
Ricketts et al.
[11] 4,296,968
[45] Oct. 27, 1981

[54] IN SITU OIL SHALE RETORT HAVING HORIZONTALLY OFFSET PILLARS

[75] Inventors: Thomas E. Ricketts, Bakersfield, Calif.; Ned M. Hutchins; Irving G. Studebaker, both of Grand Junction, Colo.

[73] Assignee: Occidental Oil Shale, Inc., Grand Junction, Colo.

[21] Appl. No.: 77,024

[22] Filed: Sep. 19, 1979

Related U.S. Application Data

[63] Continuation of Ser. No. 951,527, Oct. 16, 1978.

[51] Int. Cl.[3] ..... E21C 41/10
[52] U.S. Cl. ..... 299/2; 299/13
[58] Field of Search ..... 166/247, 249; 299/2, 299/13, 19; 102/23

[56] References Cited

U.S. PATENT DOCUMENTS

| | | | |
|---|---|---|---|
| 4,017,119 | 4/1977 | Lewis | 299/13 |
| 4,043,597 | 8/1977 | French | 299/2 |
| 4,043,598 | 8/1977 | French et al. | 299/2 |

FOREIGN PATENT DOCUMENTS

| | | | |
|---|---|---|---|
| 535418 | 11/1976 | U.S.S.R. | 299/19 |

*Primary Examiner*—William F. Pate, III
*Attorney, Agent, or Firm*—Christie, Parker & Hale

[57] ABSTRACT

An in situ oil shale retort is formed in a subterranean formation containing oil shale. Formation is excavated from within a retort site for forming a plurality of vertically spaced apart voids extending horizontally across different levels of the retort site, leaving a separate zone of unfragmented formation between each pair of adjacent voids, and leaving one or more pillars within each void for providing temporary roof support for unfragmented formation above each void. A plurality of horizontally spaced apart vertical blast holes are drilled in each zone of unfragmented formation below the voids. A pillar within a first void is offset horizontally from at least a portion of a pillar in a second void excavated directly below the first void. This provides an access region in the first void above at least a portion of the pillar in the second void so that vertical blast holes can be drilled into a zone of unfragmented formation below the pillar in the second void from the access region in the first void. Explosive is placed in the blast holes and such explosive in detonated for explosively expanding the zones of unfragmented formation toward the voids for forming a fragmented permeable mass of formation particles containing oil shale in an in situ oil shale retort. By horizontally offsetting pillars in adjacent voids, a combination of upwardly drilled and downwardly drilled blast holes can be used to place explosive throughout a zone of unfragmented formation between such voids.

58 Claims, 8 Drawing Figures

IN SITU OIL SHALE RETORT HAVING HORIZONTALLY OFFSET PILLARS

This is a continuation of application Ser. No. 951,527, filed Oct. 16, 1978.

BACKGROUND OF THE INVENTION

This invention relates to in situ recovery of shale oil from formation containing oil shale, and more particularly to techniques for explosively expanding formation toward horizontal free faces within a retort site for forming an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which, upon heating, decomposes to produce liquid and gaseous products. It is the formation containing kerogen that is called "oil shale" herein, and the liquid hydrocarbon product is called "shale oil."

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598 which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting." Such decomposition in the oil shale produces gaseous and liquid products, including gaseous and liquid hydrocarbon products, and a residual solid carbonaceous material. The liquid products and the gaseous products are cooled by the cooled oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

U.S. Pat. No. 4,043,598 discloses a method for explosively expanding formation containing oil shale toward horizontal free faces to form a fragmented mass in an in situ oil shale retort. According to a method disclosed in that patent, a plurality of vertically spaced apart voids of similar horizontal cross-section are initially excavated one above another within the retort site. A plurality of vertically spaced apart zones of unfragmented formation are temporarily left between the voids. Blast holes are drilled in each of the unfragmented zones and explosive is placed in the blast holes and detonated, preferably in a single round, to explosively expand each unfragmented zone into the voids on either side of it to form a fragmented mass. Retorting of the fragmented mass is then carried out to recover shale oil from the oil shale.

It is desirable to leave one or more pillars within each horizontal void for providing temporary roof support for unfragmented formation overlying each void. However, the presence of support pillars in the voids can inhibit effective access for drilling vertical blast holes in zones of unfragmented formation below the pillars.

There is a need to accurately control the position of explosive in blast holes throughout the retort site, including the zones of unfragmented formation below the pillars. An error in the positioning of explosive charges can produce undesirable fragmenting of formation within the retort site when such explosive is detonated for forming a fragmented mass. A blast hole drilled at an angular deviation from a desired position can result in an inaccurate placement of explosive in the retort site. For example, an error in the angle of a relatively longer blast hole can result in a greater error in the placement of an explosive charge in the bottom of the blast hole when compared with the placement of an explosive charge in the bottom of a relatively shorter blast hole having the same angular deviation from the desired position. Thus, there is a need to accurately control the placement of explosive in zones of unfragmented formation which are occluded from above by pillars in horizontal voids within a retort site.

SUMMARY OF THE INVENTION

This invention provides techniques for forming an in situ oil shale retort in a retort site in a subterranean formation containing oil shale. Formation is excavated from within the retort site for forming an upper void extending horizontally across the retort site, leaving an upper zone of unfragmented formation above the upper void, and leaving at least a first pillar of unfragmented formation within the upper void for providing temporary support for a zone of unfragmented formation above the upper void. Formation is excavated from within the retort site for forming a lower void spaced directly below the upper void, leaving an intermediate zone of unfragmented formation between the upper and lower voids, leaving a lower zone of unfragmented formation below the lower void, and leaving at least a second pillar of unfragmented formation within the lower void for providing temporary support for the intermediate zone of unfragmented formation. The second pillar pillar is offset horizontally from the first pillar so that at least a portion of an access region in the upper void extends vertically above at least a portion of the second pillar. This permits at least one vertical blast hole to be drilled downwardly from such an access region, through the intermediate zone, through the second pillar, and into the lower zone of unfragmented formation below the second pillar. Blast holes can be drilled downwardly into the intermediate zone vertically above the second pillar from open floor space in the upper void and blast holes can be drilled upwardly into the intermediate zone vertically below the first pillar from open roof space in the lower void. Explosive is placed in blast holes drilled in the zones of unfragmented formation, at least a portion of such explosive being placed in at least one blast hole drilled in the lower zone of unfragmented formation below the second pillar. Such explosive is detonated for explosively expanding formation within the retort site toward the voids for forming a fragmented permeable mass of formation particles containing oil shale in an in situ oil shale retort.

In one form of the invention, a plurality of horizontally spaced apart vertical blast holes are drilled in the intermediate zone of unfragmented formation below an upper void and in the lower zone of unfragmented formation below the lower void. The first pillar in the upper void is offset horizontally relative to the second pillar in the lower void such that any a portion of the first pillar which extends over the second pillar has a width not greater than the average spacing between the blast holes.

DRAWINGS

These and other aspects of the invention will be more fully understood by referring to the following detailed description and the accompanying drawings, in which.

Figure 5:
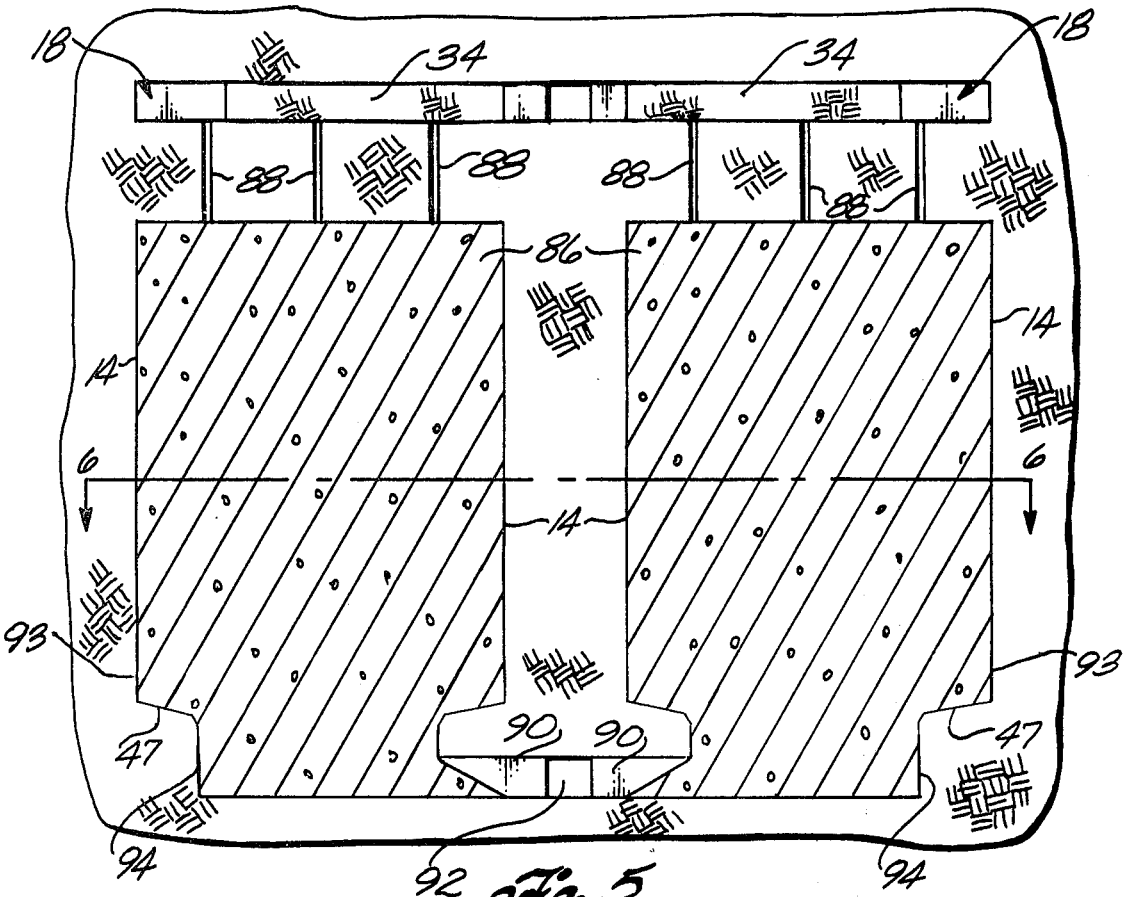
FIG. 5 is a fragmentary, semi-schematic vertical cross-sectional view showing a pair of completed in situ retorts formed according to principles of this invention.
Figure 6:
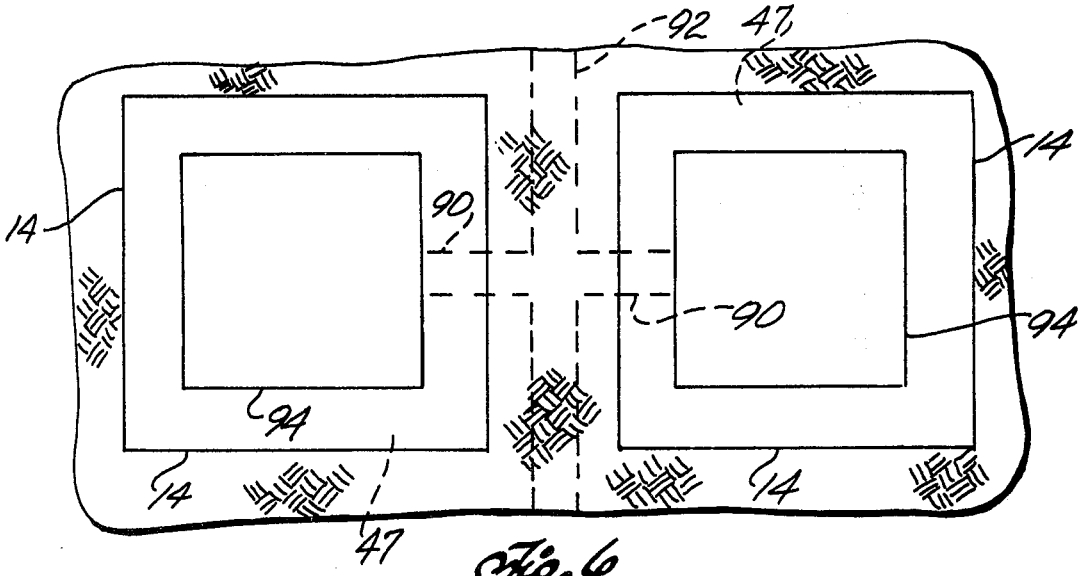
Figure 7:
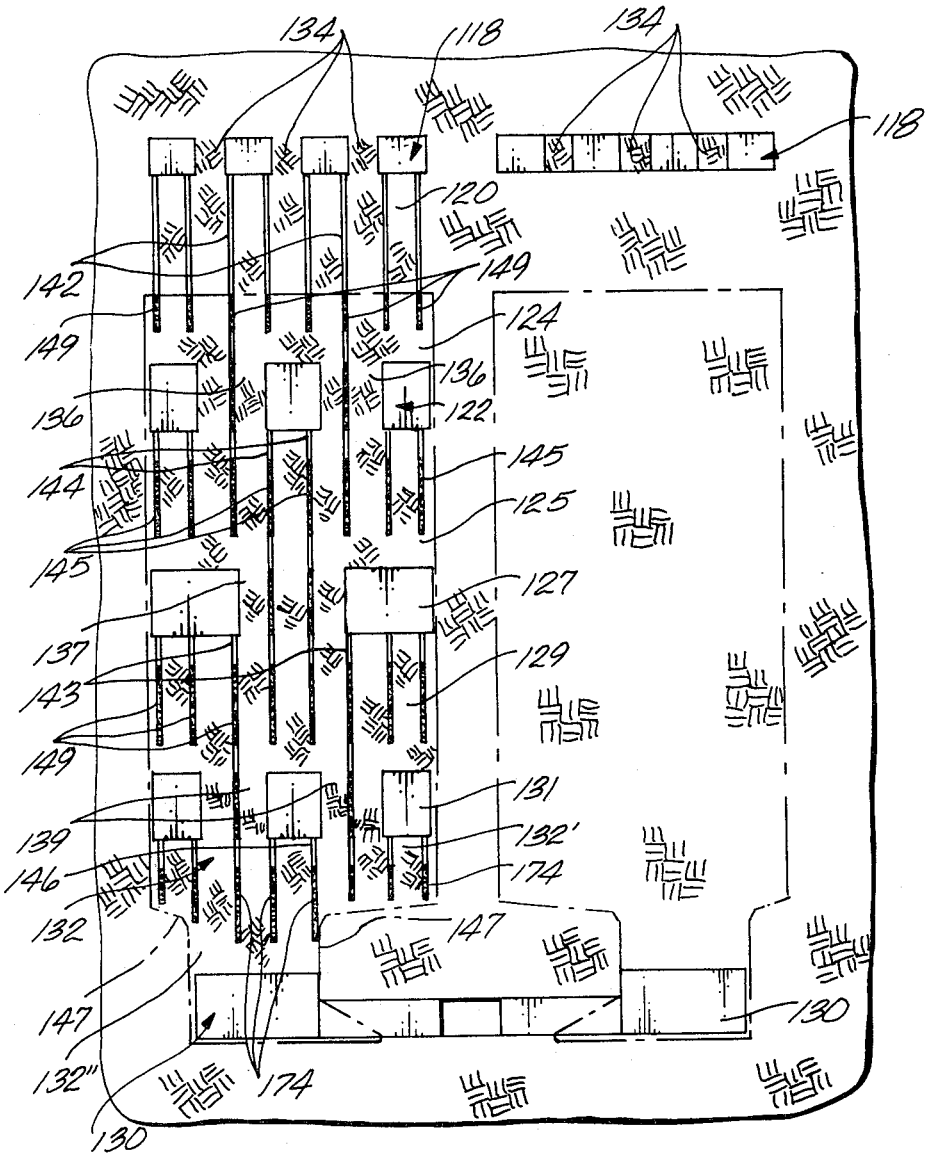
Figure 8:
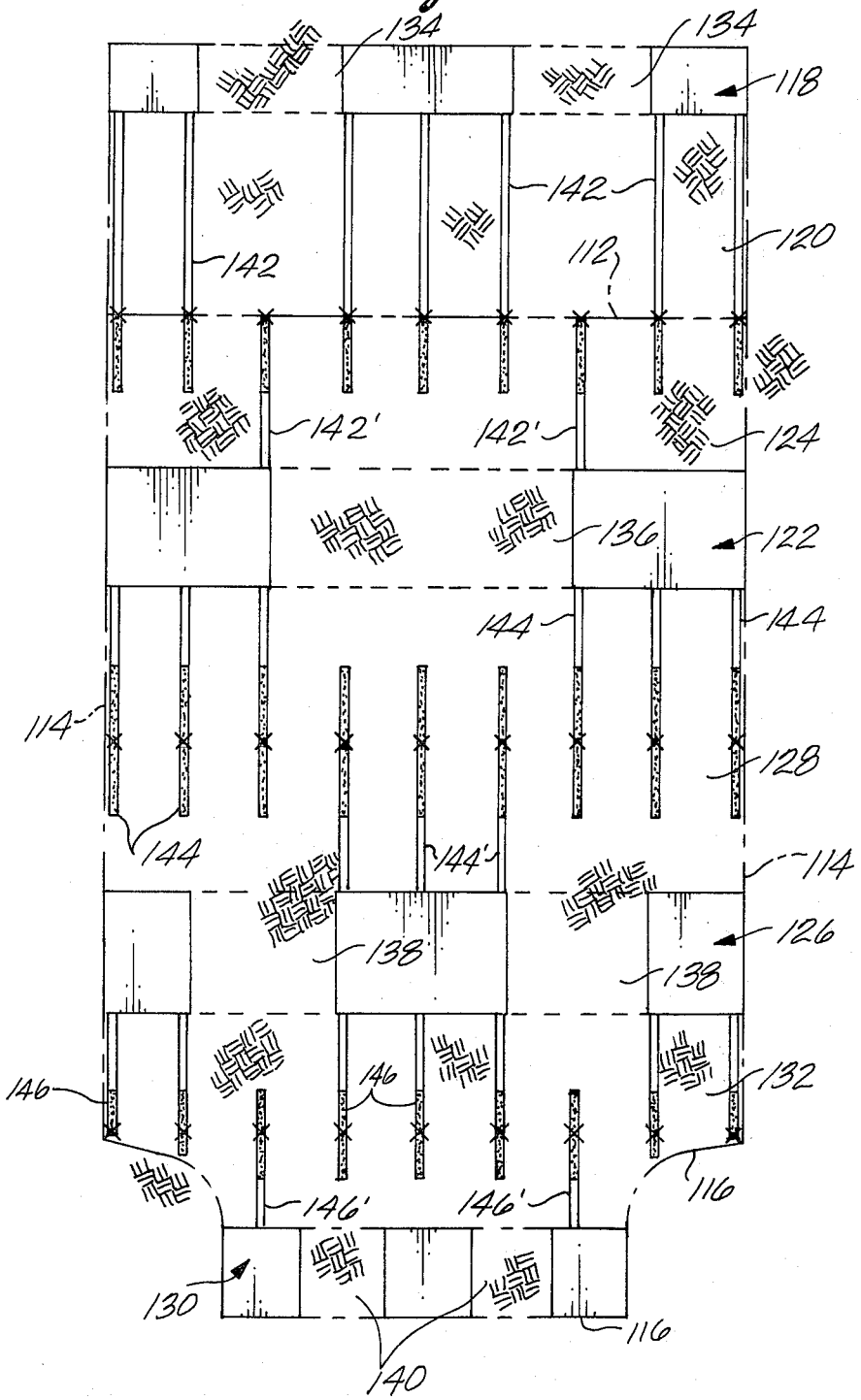

FIG. 6 is a fragmentary, semi-schematic horizontal cross-sectional view taken on line 6—6 of FIG. 5; and FIG. 7 is a fragmentary, semi-schematic vertical cross-sectional view showing an alternative method for preparing formation containing oil shale for explosive expansion for forming an in situ retort according to to principles of this invention; and FIG. 8 is a schematic vertical cross-section of an in situ oil shale retort in an intermediate stage of preparation.

DETAILED DESCRIPTION

Figure 1:
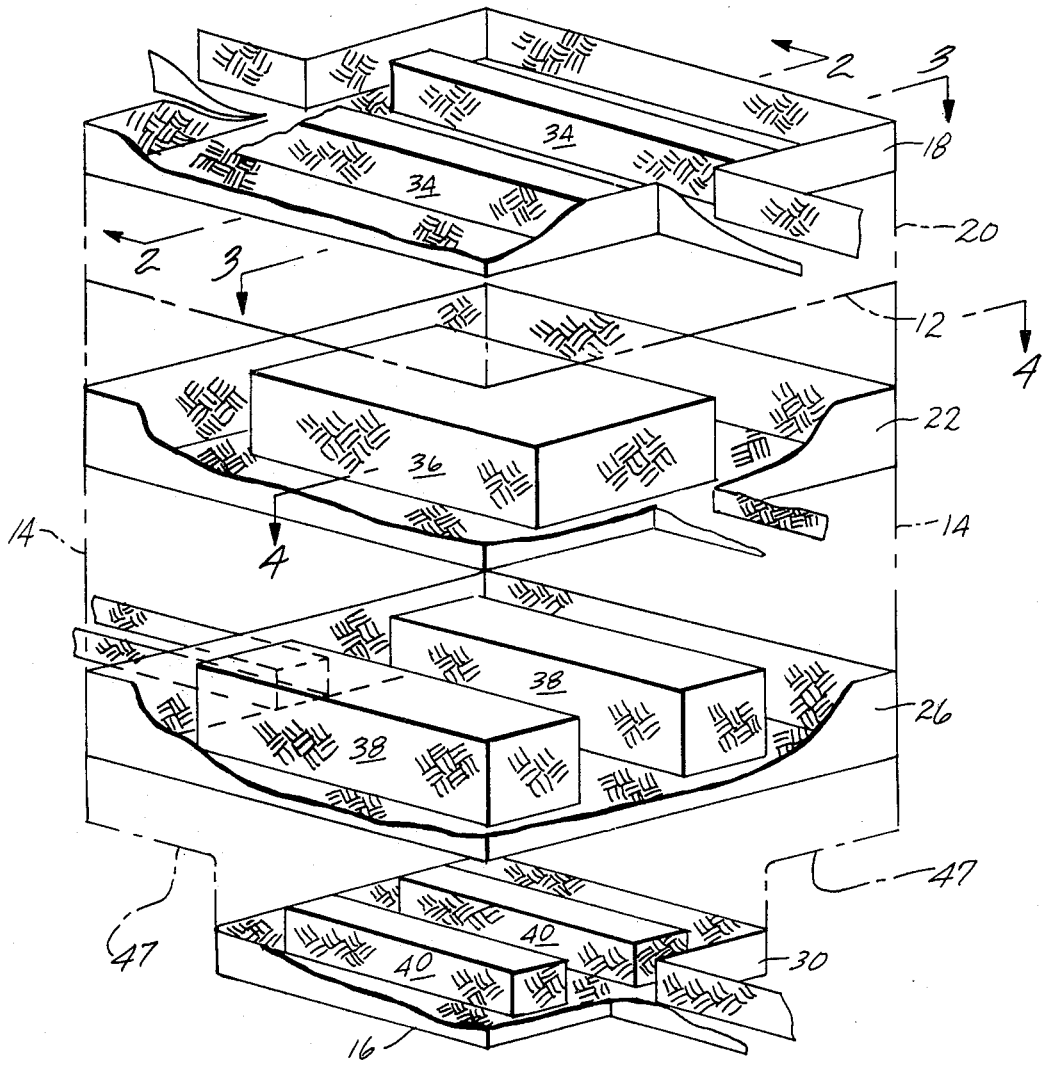
FIG. 1 is a fragmentary, semi-schematic perspective view showing a subterranean formation containing oil shale prepared for explosive expansion for forming an in situ retort according to principles of this invention.
Figure 2:
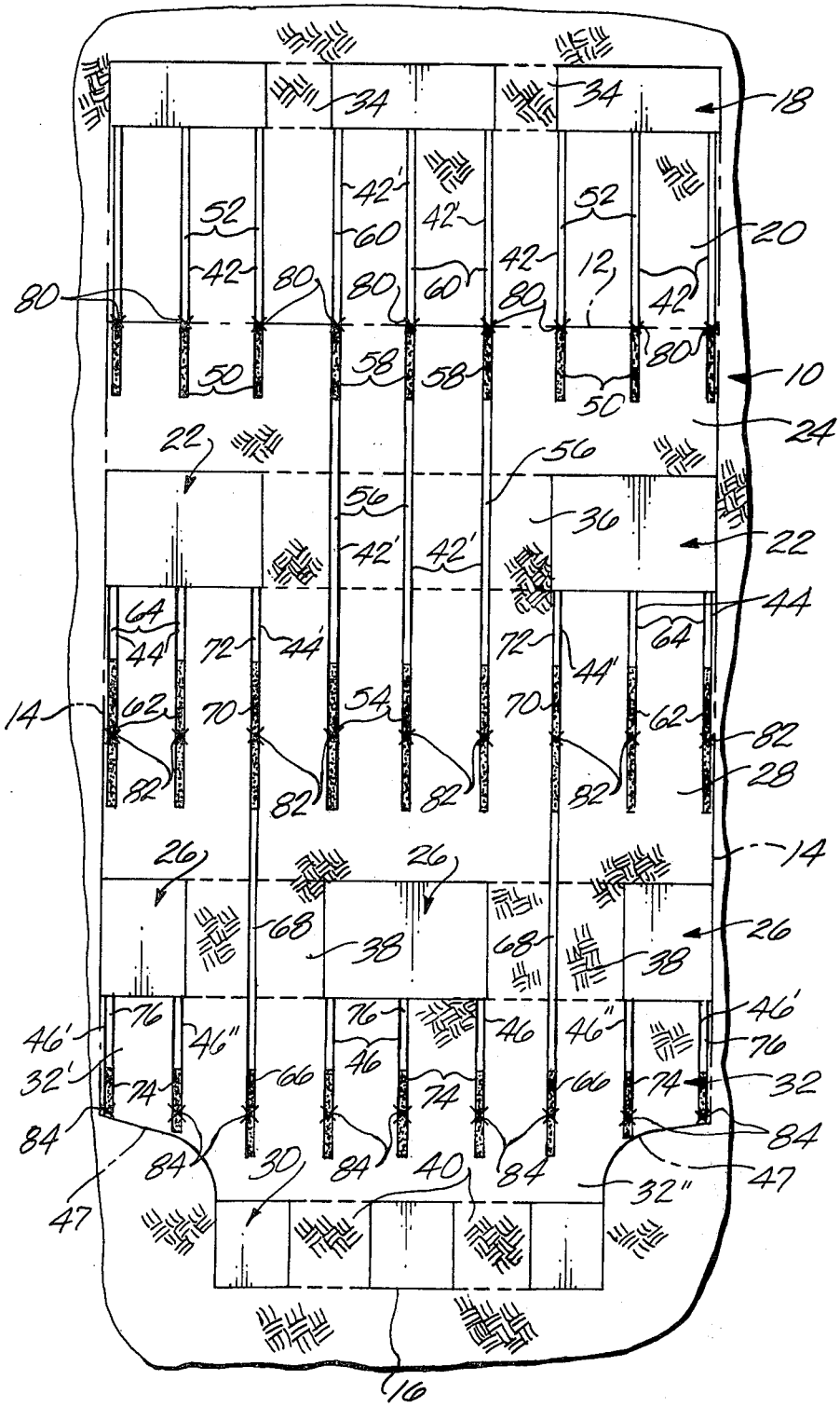
FIG. 2 is a fragmentary, semi-schematic vertical cross-sectional view taken on line 2—2 of FIG. 1.

FIGS. 1 and 2 schematically illustrate an in situ oil shale retort being formed in accordance with principles of this invention. FIG. 1 is a semi-schematic, perspective view and FIG. 2 is a semi-schematic, vertical cross-section at one stage during preparation of the in situ retort. As illustrated in FIG. 2, the in situ retort is being formed in a subterranean formation 10 containing oil shale. The in situ retort shown in FIGS. 1 and 2 is square in horizontal cross-section, having a upper boundary 12, four vertically extending side boundaries 14, and a lower boundary 16.

The in situ retort is formed by a horizontal free face system in which formation is excavated from within the retort site for forming a plurality of vertically spaced apart voids each extending horizontally across a different level of the retort site, leaving zones of unfragmented formation within the retort site adjacent pairs of horizontal voids. For clarity of illustration, each horizontal void is illustrated in FIG. 1 as a rectangular box having an open top and a hollow interior. One or more pillars of unfragmented formation remain within each void for providing temporary roof support. The pillars are illustrated as rectangular boxes inside the voids illustrated in FIG. 1.

In the embodiment illustrated in FIGS. 1 and 2, a portion of the formation within the retort site is excavated on an upper working level for forming an open base of operation 18. The floor of the base of operation is spaced above the upper boundary 12 of the retort being formed, leaving a horizontal sill pillar 20 of unfragmented formation between the floor of the base of operation and the upper boundary of the retort being formed. The horizontal cross-sectional area of the base of operation is sufficient to provide effective access to substantially the entire horizontal cross-section of the retort being formed. The base of operation provides access for drilling and explosive loading for subsequently explosively expanding formation toward the voids formed within the retort site for forming a fragmented permeable mass of formation particles containing oil shale within the upper, side and lower boundaries 12, 14, 16 of the retort being formed. The base of operation 18 also facilitates introduction of oxygen supplying gas into the top of the fragmented mass being formed below the sill pillar 20, and for this reason the base of operation is referred to below as an air level void.

In the horizontal free face system illustrated in FIGS. 1 and 2, three vertically spaced apart horizontal voids are excavated within the retort site below the sill pillar 20. A rectangular upper void 22 is excavated at a level spaced vertically below the sill pillar, leaving an upper zone 24 of unfragmented formation extending horizontally across the retort site between the upper boundary 12 of the retort being formed and a horizontal upper free face above the upper void. A rectangular intermediate void 26 is excavated at an intermediate level of the retort being formed, leaving an intermediate zone 28 of unfragmented formation extending horizontally across the retort site between a horizontal lower free face below the upper void and a horizontal upper free face above the intermediate void. In the embodiment shown, the horizontal cross-sectional area within the side boundaries of the intermediate void is similar to that of the upper void and the intermediate void is directly below the upper void.

A production level void 30 is excavated at a lower production level of the retort being formed, leaving a lower zone 32 of unfragmented formation extending horizontally across the retort site between a horizontal lower free face below the intermediate void and a horizontal upper free face above the production level void. The horizontal cross-sectional area of the upper and intermediate voids is substantially greater than the horizontal cross-sectional area of the production level void. The lower zone of unfragmented formation includes a relatively wider upper portion 32' of substantially uniform height adjacent the floor of the intermediate void. The wider upper portion 32' of the lower zone has a horizontal cross-sectional area similar to that of the intermediate void. The lower zone also includes a relatively narrower lower portion 32'' having upwardly and outwardly tapering side boundaries 47 extending between the upper free face at the production level void and the wider upper portion 32' of the lower zone. Stated another way, the lower zone of unfragmented formation has opposite outer portions offset horizontally from the side boundaries of the production level void and extending vertically between the free face at the floor of the intermediate void and the tapering lower boundary 47 of the retort being formed. An inner portion of the lower zone extends between the free face at the floor of the intermediate void and the free face at the roof of the production level void.

The upper, intermediate and lower voids can occupy between about 15% to about 25% of the total volume of formation within the retort being formed. Multiple intermediate voids can be used where the height of the retort being formed is proportionately greater with respect to its width than the retort illustrated in FIGS. 1 and 2. More than one intermediate void can be used, for example, as shown in FIG. 7, so that the in situ retort can have a substantial height without need for explosively expanding excessively thick zones of unfragmented formation between adjacent horizontal voids. The embodiment illustrated in FIGS. 1 and 2 also shows one void at the lower production level, although a plurality of horizontally spaced apart horizontal voids can be used at the elevation of the production level, if desired. Such an embodiment can be useful when the horizontal cross-section of the retort is an elongated rectangle instead of a square. In the embodiment illustrated in the drawings, each of the horizontal voids is rectangular in horizontal cross-section, with the horizontal cross-sectional area of each void being similar to that of the retort being formed. The side walls of formation adjacent the air level void, the upper void and the intermediate void lie in common vertical planes, and the side walls of formation adjacent the smaller production level void are each spaced upwardly from and extend substantially parallel to corresponding side walls of formation adjacent the air level void, the upper void and the intermediate void. Although the production level void is smaller in area than the remaining voids at the retort site (i.e., the air level void, the upper void, and the intermediate void), all four side walls of the production level void need not be spaced horizontally inwardly from corresponding side walls of the remaining voids.

In a working embodiment, the vertical distance between the upper boundary 12 and the lower boundary 16 of the fragmented mass being formed is about 270 feet. The height of the upper void and of the intermediate void is about 36 feet, and the height of the production level void is about 25 feet. The height of the upper zone of unfragmented formation is about 35 feet, the thickness of the intermediate zone of unfragmented formation is about 70 feet and the height of the lower zone of unfragmented formation is about 60 feet. The upper and intermediate voids are about 160 feet wide and 160 feet long, and the lower production level void is about 100 feet wide and 100 feet long. The height of the sill pillar is about 50 feet, and the height of the air level void is about 20 feet.

Figure 3:
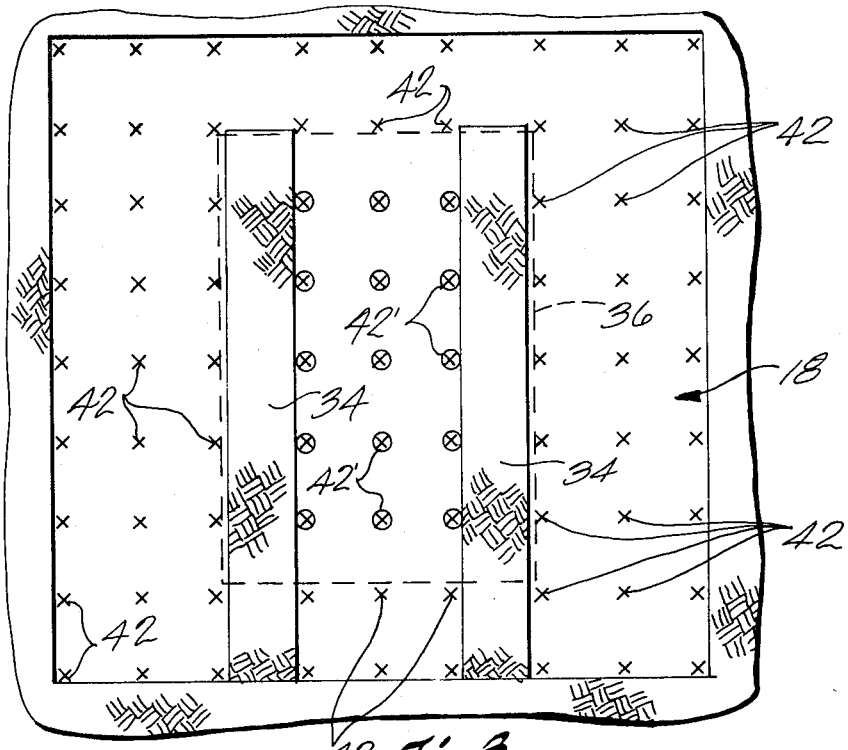
FIG. 3 is a fragmentary, semi-schematic horizontal cross-sectional view taken on line 3—3 of FIG. 1.

One or more pillars are left within each of the horizontal voids for providing temporary roof support for the zone of unfragmented formation overlying each void. Each support pillar comprises a column of unfragmented formation integral with and extending between the roof and the floor of each horizontal void. Formation can be excavated to provide pillars similar to islands in which all side walls of the pillars are spaced horizontally from corresponding side walls of formation adjacent the void; or formation can be excavated to provide pillars similar to peninsulas in which one end of the pillar is integral with a side wall of formation adjacent the void, while the remaining side walls of the pillars are spaced horizontally from the corresponding side walls of formation adjacent the void. As illustrated in FIG. 3, the air level void includes a pair of laterally spaced apart, parallel, relatively long and narrow support pillars 34 extending most of the length of the air level void. Each pillar 34 is similar to a peninsula, with one end of such a pillar being integral with a side wall of formation adjacent the air level void, forming a generally E-shaped void space within the air level void. In the illustrated embodiment, each support pillar 34 is about 16 feet wide and about 140 feet long, and the support pillars are spaced apart by a distance of about 44 feet.

Figure 4:
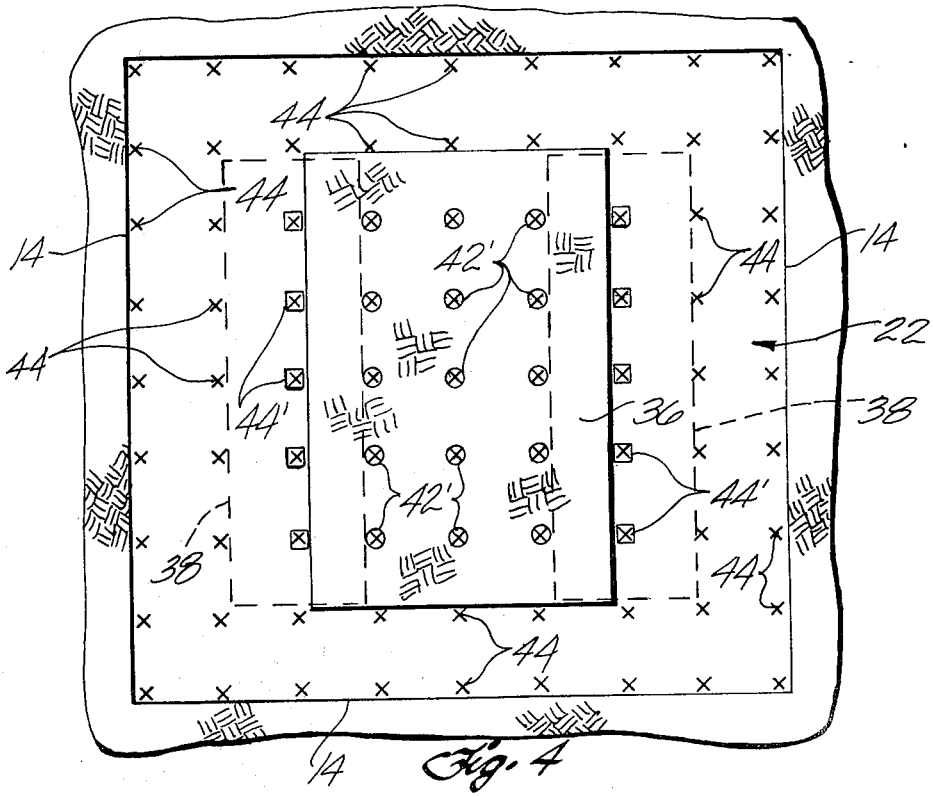
FIG. 4 is a fragmentary, semi-schematic horizontal cross-sectional view taken on line 4—4 of FIG. 1.

As illustrated in FIG. 4, the upper void 22 includes one large support pillar 36 of rectangular horizontal cross-section located centrally within the upper void. The pillar 36 is similar to an island, with all side walls of the pillar being spaced from corresponding side walls of formation adjacent the upper void, forming a generally rectangular peripheral void space surrounding all four side walls of the support pillar. In the working embodiment, the support pillar in the upper void is about 70 feet wide and about 116 feet long.

The intermediate void 26 includes a pair of laterally spaced apart, parallel, relatively long and narrow support pillars 38. As illustrated in broken lines in FIG. 4, the support pillars in the intermediate void extend a major part of the width of the void. These pillars are similar to islands in that a void space surrounds the entire periphery of each pillar. In the working embodiment illustrated in the drawings, the support pillars 38 in the intermediate void are about 36 feet wide and about 112 feet long, and adjacent inside walls of the pillars are spaced apart by a distance of about 45 feet. About 24 feet of void space is provided between the ends of each pillar and the adjacent end walls of the formation at the edges of the intermediate void. About 24 feet of void space is left between the outside wall of each pillar and the adjacent side wall of formation at the edge of the void. The excavated volume of the upper void is about the same as the excavated volume of the intermediate void so that formation expanded toward such voids has the same void volume into which to expand. This promotes uniformity of void fraction distribution.

The production level void 30 includes a pair of laterally spaced apart, relatively long and narrow, parallel support pillars 40 extending a major part of the width of the production level void. The support pillars 40 are similar to peninsulas, forming a generally E-shaped void space within the lower void. The ends of the pillars in the lower void are integral with the rear wall of the lower void, as the retort is viewed in FIG. 1. In the working embodiment illustrated in the drawings, the support pillars in the lower void are about 70 feet long and about 20 feet wide. The inside walls of the pillars are spaced apart by about 20 feet, and the outside wall of each pillar is spaced about 20 feet from the adjacent side wall of formation at the edge of the lower void.

Thus, a first or upper horizontal void within the boundaries of the retort being formed provides an open floor space vertically above at least a portion of a pillar in a second or lower horizontal void immediately below the first horizontal void. The lower void is considered to be spaced immediately below the upper void in that there is no horizontal void intervening between the upper void and the lower void. The open floor space provided by the upper void directly above a portion of the pillar in the lower void provides an access region for drilling at least one vertical blast hole from the upper void through the pillar into the zone of unfragmented formation below the pillar in the lower void. Such an open floor apace can be formed by leaving a first pillar in the upper void such that the first pillar is offset horizontally relative to at least a portion of a second pillar in the lower void. A side wall of the first pillar can be offset horizontally from a side wall of the second pillar, or the first pillar can be narrower in width than the second pillar for providing an open floor space in the upper void spaced vertically above at least a portion of the second pillar. The open floor space is of sufficient width to facilitate drilling one or more vertical blast holes down from the open floor space in the upper horizontal void, through unfragmented formation below the upper void, through the second pillar, and into the zone of unfragmented formation below the second pillar.

With reference to a working embodiment illustrated in FIG. 2, each pillar within the upper void 22 and the intermediate void 26 is accessible vertically from a horizontal void located immediately above such a void. Thus, those portions of the zones of unfragmented formation within the retort site which are occluded from above by the support pillars are accessible by vertical blast holes drilled through a pillar from an overlying excavation directly above the void in which the pillar is located. As a result, any blast holes which pass through these pillars do not pass vertically through more than one pillar. This arrangement can minimize the length of vertical blast holes drilled in formation below the pillars which, in turn, can aid in accurately positioning explosive charges throughout the retort site. Long blast holes have several shortcomings. They can deviate from their desired position due to inaccuracy in the angle of drilling. Explosive in such holes can be desensitized by the pressure of material in the blast hole. If plural charges are used in such holes complexity of loading is introduced by need for plural detonators.

In the working embodiment illustrated in FIG. 2, the pillars 34 in the air level void 18 extend vertically above only the outer portions of the pillar 36 in the upper void 22. A central portion of the pillar 36 in the upper void 22 is located vertically below the open floor space extending between the pillars 34 in the air level void. As illustrated strated in FIG. 3, the open floor space between the pillars 34 in the air level void extends for the entire length of the pillar in the upper void. Thus, at least a portion of the pillar 36 in the upper void, as well as the zone of unfragmented formation below the pillar in the upper void can be reached by one or more vertical blast holes 42' drilled down from the floor of the air level void, through the sill pillar 20, through the upper zone 24 of unfragmented formation, through the pillar in the upper void, and into the intermediate zone 28 of unfragmented formation below the pillar in the upper void.

The pillars 38 in the intermediate void are offset horizontally relative to the pillar 36 in the upper void 22. The inside portions of the two pillars in the intermediate void are located directly below the outer portions of the pillar in the upper void, that is, there is some overlap of the upper and lower pillars. The outer portions of the pillars in the intermediate void are located vertically below an open floor space adjacent opposite side walls of the pillar in the upper void. As illustrated in FIG. 4, at least a portion of the entire length of each pillar 38 in the intermediate void is accessible from an open floor space in the upper void. Thus, the zone of unfragmented formation below each pillar in the intermediate void can be reached by one or more vertical blast holes 44' drilled down from the floor of the upper void, through the intermediate zone 28 of unfragmented formation, through a pillar 38 in the intermediate void, and into the lower zone 32 of unfragmented formation below such a pillar.

The support pillars 40 in the production level void 30 are shown in FIG. 2 as being offset horizontally relative to corresponding pillars 38 in the intermediate void. According to principles of this invention, the pillars in the production level void need not be offset horizontally from the pillars in the intermediate void, inasmuch as access is not required for drilling blast holes into zones of unfragmented formation below the pillars in the production level void. The production level pillars can be offset if desired to permit vertical blast hole drilling into such pillars so that the pillars can be fragmented by explosive in such vertical blast holes.

Although the entire width of a support pillar in any of the horizontal voids can extend below an open floor space in a horizontal void immediately above such a pillar, it can be desirable for the upper, intermediate and production level voids to include at least one pillar positioned vertically below at least a portion of a pillar in an overlying horizontal void. This provides a continuity of structural support from top to bottom throughout the retort site for supporting the overburden overlying the retort site. This can be employed when the zone of unfragmented formation between adjacent voids is relatively thin. In the working embodiment herein described there is sufficient redistribution of stress by the 70 foot thickness of the intermediate zone 28 that no horizontal overlap of pillars in the upper and intermediate voids is needed.

Vertical blast holes can be drilled downwardly in all portions of the unfragmented formation within the boundaries of the retort site from an overlying excavation adjacent such unfragmented formation, except for regions of unfragmented formation within the retort site which are occluded from above by the support pillars. In these regions the horizontally offset support pillars can facilitate drilling of vertical blast holes into formation below the pillars from an access region in an overlying void by drilling downwardly through such a pillar. Such blast holes are drilled without passing through more than one pillar.

Referring to a working embodiment illustrated in FIG. 2, a plurality of mutually spaced apart vertical upper blast holes 42 are drilled down from the air level void through the sill pillar 20 and into at least an upper portion of the upper zone 24 of unfragmented formation above the upper void 22. The upper blast holes 42 are substantially equidistantly spaced apart in each of a plurality of rows extending across the width of the air level void. The rows of upper blast holes are parallel to one another and the rows are substantially equidistantly spaced apart from one another from the front to the rear of the air level void, the spacing between rows being the same as the spacing between blast holes in each row. The upper blast holes within each row are aligned with corresponding upper blast holes in adjacent rows to form a symmetrical pattern comprising a square matrix or array of blast holes across the floor of the air level void.

In this embodiment, the drilling pattern for the upper blast holes is illustrated by x's shown at 42 in FIG. 3. There are nine upper blast holes in each row, and the blast holes are mutually spaced apart on 20-foot centers. A portion of the upper blast holes in the three centrally located rows are drilled down from an access region of the air level void directly above the support pillar 36 in the upper void, and these fifteen upper blast holes (identified by reference numeral 42' and a circle surrounding an x in FIGS. 3 and 4) are longer than the remaining shorter upper blast holes 42 which are drilled down from the air level void into unfragmented formation above the portion of the upper void not occupied by the support pillar 36. In this embodiment, the fifteen longer upper blast holes 42' are drilled down from the floor space between the two support pillars 34 within the air level void. These longer upper blast holes are drilled through the sill pillar, through the upper zone of unfragmented formation, through the pillar 36 in the upper void, and through about three-fourths of the depth of the intermediate zone 28 of unfragmented formation. Each of the longer upper blast holes is about 170 to 175 feet long, and there are a total of fifteen of such blast holes, five in each row. For the embodiment shown, the remaining 66 shorter upper blast holes 42 are about 65 to 70 feet long and are drilled down from the air level void through the entire depth of the sill pillar and through about the upper half of the upper zone 24 of unfragmented formation.

In this embodiment, a plurality of mutually spaced apart vertical intermediate blast holes 44 are drilled down from the floor of the upper void 22 into at least a portion of the intermediate zone 28 of unfragmented formation below the upper void 22. The intermediate blast holes are drilled in a symmetrical pattern in which they are substantially equidistantly spaced apart across the width of the upper void in parallel rows which are equidistantly spaced apart from one another by the same distance to form a square matrix of blast holes similar to the upper blast holes in the air level void. There are nine intermediate blast holes drilled in each row, except for the area occupied by the pillar 36 in the upper void, and the blast holes are mutually spaced apart on 20-foot centers. Each intermediate blast hole is drilled vertically below a corresponding upper blast hole. The desired pattern of drilling the intermediate blast holes is illustrated by x's shown at 44 in FIG. 4. A portion of the intermediate blast holes are drilled through the support pillars 38 in the intermediate void, and these ten intermediate blast holes (identified by reference numeral 44' and by a square surrounding each x in FIG. 4) are longer than the remaining shorter intermediate blast holes 44. Each of the ten longer intermediate blast holes is drilled down from a floor space in the upper void immediately adjacent a corresponding outside wall of the support pillar 36 in the upper void. These ten longer intermediate blast holes are drilled down from the upper void, through the entire depth of the intermediate zone 28 of unfragmented formation, approximately through the center of the support pillars 38 in the intermediate void, and through about three-fourths the depth of the lower zone 32 of unfragmented formation below the intermediate void. In this embodiment, the ten longer intermediate blast holes 44' are about 155 to 160 feet long and there are five of such blast holes in each row. In this same embodiment, the remaining 56 shorter intermediate blast holes extend through about three-fourths the depth of the intermediate zone 28 of unfragmented formation and are about 50 to 55 feet long.

A plurality of mutually spaced apart vertical lower blast holes 46 are drilled down from the floor of the intermediate void into a portion of the lower zone 32 of unfragmented formation below the intermediate void. The lower blast holes are drilled on a symmetrical pattern in which they are substantially equidistantly spaced apart across the width of the intermediate void in parallel rows which are also equidistantly spaced apart by the same distance, forming a square matrix or array of blast holes similar to the square patterns of the upper and intermediate blast holes. There are nine lower blast holes in each row, except for the area occupied by the pillars 38 in the intermediate void, and the blast holes are mutually spaced apart on 20-foot centers. Each lower blast hole is drilled vertically below a corresponding upper blast hole and a corresponding intermediate blast hole.

A first group of the lower blast holes nearer the perimeter of the retort extend to the bottom boundary 47 of the fragmented mass being formed in a region of the lower zone horizontally offset from the production level void. A second group of the lower blast holes nearer the center of the retort extend into the region of the lower zone above the production level void.

Included in the first group of lower blast holes are an outer or perimeter band of 32 blast holes surrounding the intermediate void. These blast holes are drilled shorter in length than the remaining lower blast holes. Also included in the first group of the lower blast holes are a second band of 24 blast holes immediately inside the outer band. The blast holes in the second band are drilled longer in length than the blast holes in the outer band, but shorter in length than the remaining longer lower blast holes.

The second group of lower blast holes comprise the longer lower blast holes which are drilled in the central region of the lower zone of the unfragmented formation. In a working embodiment, portions of three rows of longer lower blast holes 46 are drilled down from an open floor space in the intermediate void between the pillars 38 in the intermediate void, and there are five such blast holes in each row. These fifteen longer lower blast holes extend through about three-fourths the depth of the lower zone of unfragmented formation, and each of these blast holes is about 47.5 feet long. The lower portion of each longer intermediate blast hole 44' is drilled through a pillar 38 and into the lower zone of unfragmented formation from an access region of the floor of the upper void. These portions of the intermediate blast holes extend in rows on opposite sides of the rows of longer lower blast holes 46 drilled from the intermediate void. The lower portions of the intermediate blast holes 44' are drilled to about the same depth in the lower zone as the longer lower blast holes, i.e., to about 47.5 feet below the elevation of the floor of the intermediate void. The short lower blast holes 46' in the outer band are drilled down in the lower zone of unfragmented formation adjacent each side boundary 14 of the retort being formed. The short lower blast holes terminate near the bottom boundary 47 of the fragmented mass being formed which tapers slightly downwardly and inwardly to provide a slightly sloping step. The short lower blast holes 46' surround the second band of slightly longer lower blast holes 46''. The blast holes in the second band define the location of the bottom boundary 47 of the fragmented mass being formed. There are 32 short lower blast holes 46' in the outer band adjacent a corresponding side boundary 14 of the retort. There are 24 lower blast holes 46'' in the second band immediately inside the outer band of short lower blast holes. As set forth in greater detail below, the upper portion 32' of the lower zone of formation below the intermediate void is explosively expanded upwardly toward that void. The lower portion 32'' of formation above the production level void 30 is expanded toward that void. In a working embodiment the distance between the floor of the intermediate void 26 and the roof of the lower void 30 is about 60 feet. The upper 35 feet of this zone is expanded upwardly toward the intermediate void and the lower 25 feet of the central part of the lower zone is expanded downwardly toward the production level void. The blast holes 46' in the outermost band extend to the bottom of the portion 32' expanded upwardly. The holes 46 and 44' in the region overlying the production level void extend downwardly half way through the lower portion 32'. Thus, the bottoms of these holes are about 15 feet above the roof of the production level void. The holes 46'' in the second band extend through the upper portion 32' expanded toward the intermediate void and about $\frac{1}{4}$ of the thickness of the lower portion 32'' expanded downwardly toward the production level void. In a working embodiment, each lower blast hole in the second band is about 42.5 feet long, and each lower blast hole in the outer band is about 35 feet long. Thus, the bottom boundary in the region surrounding the lower production level has a slope with a fall of about one foot per three feet of horizontal distance.

Thus, a pair of vertically adjacent horizontal voids are excavated within the retort site so that a first pillar in a first horizontal void is offset horizontally relative to a second pillar in a second horizontal void located directly below the first horizontal void. Any portion of the first pillar which extends over or overlaps the second pillar has a width not greater than the average spacing between blast holes extending from the first void into unfragmented formation between the first void and the second void. By keeping the overlap of pillars less than the spacing between blast holes, open floor space is available over each pillar to permit drilling blast holes in an entire array below a lower void either from the lower void or from the void immediately overlying the lower void. Thus the maximum overlap of pillars is less than the spacing between blast holes in the array. Such relative alignment of the pillars enables blast holes to be drilled into unfragmented formation below the second void by drilling vertically through such a pillar in the second void. This arrangement permits drilling of blast holes into unfragmented formation below the second void that is occluded by a pillar in the second void.

In a working embodiment, as best illustrated in FIG. 2, each pillar 34 in the air level void 18 has a width less than the spacing between the upper blast holes 42, 42'. This allows the upper blast holes to be drilled down from the air level void along opposite side walls of each pillar in the air level void. Thus, all blast holes drilled through the sill pillar and into the upper zone 24 of unfragmented formation can be drilled from the overlying excavation provided by the air level void. This avoids drilling much longer blast holes through the support pillars 34 in the air level void from an overlying location, such as above ground level.

The outer portions of the pillar 36 in the upper void extend over corresponding inner portions of the pillar 38 in the intermediate void. The width of each portion of the pillar in the upper void which extends over a portion of a pillar in the intermediate void is less than the spacing between blast holes. This facilitates drilling intermediate blast holes into the intermediate zone of unfragmented formation from locations within the upper void adjacent the pillar in the upper void.

Thus, in each zone of unfragmented formation to be explosively expanded, vertical blast holes can be drilled downwardly from the void overlying that zone or from the next void immediately above the void over the zone. That is, in a zone of unfragmented formation below a first void, vertical blast holes can be drilled downwardly directly from the floor of the first void or from the floor of a second void immediately above the first void. Any regions occluded by pillars in the first void are reached by vertical blast holes drilled from the second void downwardly through such pillars. Any pillars in the overlying second void are sufficiently offset horizontally from such a pillar in the underlying void to provide an access region for such drilling. By keeping any horizontal overlap of pillars less than the spacing between blast holes, the entire array of blast holes can be drilled from the two voids.

The pillars 40 within the lower production level void 30 are shown extending below the pillars of the intermediate void by a width less than the spacing between blast holes within the retort site. The portion of each pillar in the lower void which extends below a corresponding pillar 38 in the intermediate void can be greater than the spacing between the blast holes if desired, since the pillars in the production level void do not occlude any blast holes being drilled into unfragmented formation below the production level void. Overlap less than the spacing can be used when it is desired to use vertical blast holes in such production level pillars for explosively expanding such pillars.

The blast holes are loaded with explosive and such explosive is detonated in a single round to explosively expand formation upwardly and downwardly toward the upper void upwardly and downwardly toward the intermediate void and downwardly toward the lower void for forming a fragmented permeable mass of formation particles containing oil shale in the in situ retort being formed. According to principles of this invention, explosive expansion upwardly and downwardly toward a given horizontal void is symmetrical. That is, for each horizontal void having upper and lower horizontal free faces toward which formation is explosively expanded, the amount of formation explosively expanded upwardly toward such a void is substantially the same as the amount of formation explosively expanded downwardly toward such a void. In the embodiment illustrated in the drawings, the same amount of formation is expanded upwardly and downwardly toward the upper void 22, and the same amount of formation is explosively expanded upwardly and downwardly toward the intermediate void.

In an embodiment having a plurality of horizontal voids within a retort site wherein formation is explosively expanded upwardly and downwardly toward each horizontal void, substantially the same amount of formation is explosively expanded toward each void. Further, the amount of formation explosively expanded upwardly toward each void is substantially equal to the amount of formation explosively expanded downwardly toward each void.

Symmetrical blasting toward each horizontal void is provided by explosively expanding a substantially uniform depth of formation upwardly and downwardly toward each void across the entire width of such a void. Placement of explosive charges in the blast holes is best understood with reference to FIG. 2. To more clearly illustrate placement of explosive and stemming in the blast holes, the blast holes are shown out of proportion in FIG. 2, i.e., the diameter of the blast holes is actually much smaller in relation to the horizontal dimensions of the retort than is shown in FIG. 2. In a working embodiment, approximately 35 feet of formation, i.e., the entire upper zone 24 of unfragmented formation is explosively expanded downwardly toward the upper void 22 and approximately 35 feet of formation occupying the upper half of the intermediate zone 28 of formation below the floor of the upper void is simultaneously expanded upwardly toward the upper void. Similarly, approximately 35 feet of formation occupying the lower half of the intermediate zone of unfragmented formation above the roof of the intermediate void 26 is explosively expanded downwardly toward the intermediate void while approximately 35 feet of formation occupying the upper portion 32' of the lower zone of unfragmented formation is simultaneously explosively expanded upwardly toward the intermediate void.

The lower portion 32" of the lower zone of unfragmented formation is explosively expanded downwardly toward the lower production level void 30. The proportionate amount of formation explosively expanded downwardly toward the production level void can be less than the proportionate amount of formation explosively expanded upwardly or downwardly toward the upper void or toward the intermediate void to result in a larger void fraction in the portion of the fragmented mass at the elevation of the production level void than the void fraction of the portion of the fragmented mass at the elevation of the intermediate void for example, or than the average void fraction in the fragmented mass.

In a working embodiment, approximately the lower 17.5 feet of the short upper blast holes 42 are loaded with separate columns of explosive 50 up to the top of the upper zone of unfragmented formation, and the top portions 52 of the short upper blast holes, which extend for a depth of about 50 feet through the sill pillar, are stemmed with an inert material such as sand or gravel. Thus, the columns of explosive in the short upper blast holes extend through approximately the upper half of the upper zone of unfragmented formation.

The long upper blast holes 42' are drilled to about 17.5 feet above the roof of the intermediate void, and approximately the bottom 35 feet of these blast holes are loaded with separate lower columns 54 of explosive. Thus, the lower columns of explosive in these blast holes extend through the middle half of the intermediate zone of unfragmented formation. The intermediate portion 56 of each of these blast holes extends through approximately the upper 17.5 feet of the intermediate zone of unfragmented formation, through the 36 feet depth of the support pillar 36 in the upper void, and through approximately the bottom 17.5 feet of the upper zone of unfragmented formation. This intermediate portion 56 of each of the blast holes is stemmed. A separate upper column 58 of explosive approximately 17.5 feet long is loaded above the stemming in each of the intermediate portions of these blast holes. These 17.5 feet long upper columns of explosive extend through the upper half of the upper zone of unfragmented formation, i.e., for approximately the same depth as the explosive columns 50 in the short upper blast holes 42. The remaining upper portions 60 of the long upper blast holes 42', i.e., the portions which extend through the sill pillar, are stemmed.

The short intermediate blast holes 44 are drilled down from the upper void 22 to about 17.5 feet above the roof of the intermediate void, and approximately the bottom 35 feet of these blast holes are loaded with separate columns 62 of explosive. The remaining upper portions 64 of these blast holes extend through approximately the top 17.5 feet of the intermediate zone of unfragmented formation, and this portion of each of the short intermediate blast holes is stemmed. Thus, the columns of explosive in the short intermediate blast holes extend through approximately the middle half of the intermediate zone of unfragmented formation. These columns of explosive correspond to the lower columns 54 of explosive in the longer blast holes drilled from the air level void through the pillar 36 and into the intermediate zone of unfragmented formation.

The long intermediate blast holes 44' are drilled down from the upper void to about 47.5 feet below the floor of the intermediate void, and approximately the lower 30 feet of these blast holes are loaded with lower columns 66 of explosive. Thus, the lower columns of explosive extend through approximately the lower half of the upper portion 32' of the lower zone which is explosively expanded upwardly toward the intermediate void plus the upper half of the lower portions 32" of the lower zone which is explosively expanded downwardly toward the production level void. Intermediate portions 68 of these blast holes extend through approximately the upper 17.5 feet of the lower zone of unfragmented formation, through the entire 36 feet depth of a corresponding pillar 38 in the intermediate void, and through approximately the lower 17.5 feet of the intermediate zone of unfragmented formation. This intermediate portion 68 of each of the long intermediate blast holes is stemmed. Approximately the next 35 feet of each of these blast holes is loaded with an upper column 70 of explosive, and the upper portion 72 of each of these blast holes is stemmed for a depth of approximately 17.5 feet. Thus, the upper columns of explosive extend through approximately the middle half of the intermediate zone of unfragmented formation.

The bottom portions of the lower blast holes 46 are loaded with explosive 74 up to a level approximately 17.5 feet below the floor of the intermediate void. This provides columns 74 of explosive approximately 32.5 feet long in the long lower blast holes 46, columns 74 of explosive approximately 25 feet long in the lower blast holes 46'' in the second band, and columns of explosive approximately 17.5 feet long in the short lower blast holes 46' in the outer band. The upper portions 76 of all the lower blast holes are stemmed for a depth of approximately 17.5 feet below the floor of the intermediate void.

In a working embodiment, the burden distance to each of the upper and lower horizontal free faces of formation adjacent the upper void is substantially the same, i.e., about 26 feet. The burden distance is measured vertically from the centroid of each column of explosive to the nearest free face. In the intermediate zone of unfragmented formation between the upper and intermediate voids half of the formation is explosively expanded upwardly toward the upper void and half is expanded downwardly toward the intermediate void. The central plane of this zone can be considered to be neutral. The half of each column of explosive above this central plane is about 17.5 feet long and is effective for expanding formation toward the upper void. This upper half of the explosive columns has essentially no effect on formation in the lower half of the intermediate zone. Further, since the hole diameters are all the same the amount of explosive in each blast hole is the same as in each other blast hole in the same zone of unfragmented formation. The effective centroid of each column of explosive expanding formation toward an adjacent void is the same distance from the adjacent free face as each other. The scaled depth of burial (SDOB) of each explosive charge is, therefore, equal to each other charge. Since the scaled depth of burial of the upper and lower explosive charges adjacent the upper void are substantially the same, explosive expansion toward the upper void is symmetrical, that is, the same amount of formation is explosively expanded upwardly and downwardly toward the upper void.

Similarly, since the scaled depth of burial of each of the upper and lower columns of explosive adjacent the intermediate void are substantially the same, the same amount of formation is explosively expanded upwardly and downwardly toward the intermediate void. The effective scaled depth of burial of each half of the explosive columns in the intermediate zone of unfragmented formation is equal. Symmetrical expansion of this zone is therefore obtained. Scaled depth of burial as it applies to cratering or blasting to a horizontal free face is discussed in a paper by Bruce B. Redpath entitled "Application of Cratering Characteristics to Conventional Blast Design," a copy of which accompanies this application. The scaled depth of burial of an explosive charge can be expressed in units of distance over weight or preferably energy of explosive to the one third power ($d/w^{\frac{1}{3}}$). The distance (referred to as burden distance) in the equation for SDOB is measured from the free face to the effective centroid of the explosive. The weight or energy is the total for the column of explosive. In the working embodiment the centroid of the explosive column in each blast hole is about 11 $mm/cal^{\frac{1}{3}}$. The effective centroid of each column of explosive is about eight meters from the free face and the energy of each is about $3.85\times10^8$ calories.

The scaled depth of burial for an array of columns of explosive can be less than the scaled depth of burial of the individual explosive charges since interaction between the explosive charges can occur upon detonation. The same effective scaled depth of burial for an array of explosive charges can be obtained with a variety of patterns of blast holes. Thus, for example, the same effective scaled depth of burial can be obtained with either (a) relatively large charges at relatively wide spacing between holes, or (b) relatively smaller charges at relatively smaller spacing between holes. What is desired is that the effective scaled depth of burial of the arrays of explosive on each side of a void are substantially the same.

Detonation of each explosive charge is initiated remote from the end of the column of explosive nearest the free face toward which formation is explosively expanded when the explosive is detonated. When so detonated the direction of propagation of detonation through explosive is toward the free face. In the working embodiment, separate detonators (represented by an x at 80 in FIG. 2) are placed above the columns of explosive 50 and 58 in the blast holes in the upper zone of unfragmented formation. Thus, each of these detonators is at the same level, namely, at the top of the upper zone of unfragmented formation, approximately 35 feet from the upper free face adjacent the upper void. Detonation of explosive in the upper blast holes is initiated such that the direction of propagation of detonation is toward the upper free face adjacent the upper void.

In the intermediate zone of unfragmented formation, a detonator or a plurality of detonators for redundancy, (represented by an x at 82 in FIG. 2) is placed in the center of each column of explosive for initiating detonation of such explosive upwardly toward the upper void and downwardly toward the lower void. These detonators are positioned at a level approximately mid-way between the lower free face of formation adjacent the upper void and the upper free face of formation adjacent the lower void. The detonators are initiated so that equal amounts of formation are explosively expanded upwardly toward the upper void and downwardly toward the lower void. Detonation is initiated in the middle of the intermediate zone so that detonation propagates toward each of the two adjacent free faces, and such initiation results in a better cratering effect than initiation at other points within the intermediate zone.

Thus, in each of these two zones of unfragmented formation, detonation of each explosive charge is initiated remote from the free face toward which formation is expanded. There are two situations as described herein where detonation is initiated remote from the free face.

The first of these situations is in the upper zone of unfragmented formation where explosive expansion is only in one direction, i.e., downwardly toward the upper void. In this situation the detonators are located at the end of the column of explosive furthest from the free face at the roof of the upper void. This location is most remote from the free face.

In the second situation a column of explosive is provided midway between two free faces, as for example in the intermediate zone of unfragmented formation between the upper void and the lower void. In this situation detonation is initiated at the mid point of the column of explosives about half way between the two free faces. This location is most remote from each free face with respect to that portion of the column of explosive which expands formation towards the respective free face.

In either situation the detonators may actually be located a small distance from the most remote portion of the column of explosive. For example, in the first situation, the detonator may be a foot or so from the end of the column of explosive to assure that it is buried in the explosive for reliable detonation. Similarly, detonators located at the mid point of the column of explosive, as in the intermediate zone, can be located somewhat off center due to errors in measurement or placement. Such deviations are routine and have minimal effect on the resulting explosive expansion. Even with such deviations from precise location of the detonators the direction of propagation of detonation in the explosive is substantially towards the respective free face.

Separate detonators (represented by an x at 84 in FIG. 2) are placed at about the same level in the columns of explosive in the lower zone of unfragmented formation, namely, about 35 feet below the lower free face adjacent the intermediate void. Detonation of explosive in the lower blast holes is initiated such that the direction of propagation of detonation is upwardly toward the lower free face adjacent the intermediate void. Detonation the portions of the lower blast holes above the production level void propagates toward the free face at the roof of the production level void for explosive expansion of formation within the lower portion 32″ of the lower zone toward the production level void.

Explosive is also placed in the support pillars in the upper, intermediate and lower voids. Horizontally extending blast holes (not shown) can be drilled in the pillars and such blast holes are loaded with explosive in preparation for explosively expanding the pillars. A variety of arrangements of horizontal blast holes can be used depending on the size and shape of the pillars. Alternatively, the vertical blast holes drilled through the pillars can be loaded with explosive charges, as illustrated in FIG. 7. Sufficient explosive is placed in the pillars to explosively expand all of each pillar toward its respective void. It is desired to detonate explosive in the larger single pillar in the upper void shortly before detonating explosive in the smaller pair of pillars in the intermediate void to better distribute fragments of the pillars across the voids. It is also desirable to detonate explosive in all the pillars (those in the upper, intermediate and production level voids) before detonating explosive in the zones of unfragmented formation within the retort site so that the pillars do not interfere with explosive expansion of the zones of unfragmented formation. Thus, explosive in the zones of unfragmented formation is not detonated until shortly after the pillars have been explosively expanded to create a substantially continuous free face of formation adjacent the top and bottom of each horizontal void. The pillars 40 in the production level void can be explosively expanded a substantial time before expanding the balance of formation at the retort site since the roof span of this void is small enough that the roof will remain in place for at least many weeks or months.

Following explosive loading within the retort site, explosive is detonated in a single round of explosions for explosively expanding the unfragmented zones toward the horizontal free faces of formation adjacent the voids for forming a fragmented permeable mass 86 (see FIG. 5) of formation particles containing oil shale in an in situ oil shale retort. Explosive in the larger pillar 36 in the upper void is detonated first, followed a short time later by detonation of explosive in the smaller pillars 38 in the intermediate void. About 100 milliseconds after detonation of the last explosive in the pillars, detonation of explosive in the zones of formation to be expanded toward the voids commences. Time delays are employed in the blast holes in each zone so that the amount of explosive detonating in each delay interval is minimized. The total time to execute the single round during which the pillars 36 and 38 and the zones of formation 24, 26 and 32 are expanded is less than one half second.

The symmetrical blasting pattern enhances the chance of production of a generally uniformly distributed void fraction in the fragmented mass. The same amount of formation is expanded toward each void and the same amount of formation is expanded from above and below each of the voids. The symmetrical blasting arrangement also enhances predictability of effects of such parameters as powder factor, time delay values, etc., on the uniformity of particle size in the fragmented mass.

FIG. 5 illustrates a pair of horizontally spaced apart adjacent retorts each containing a fragmented permeable mass of formation particles containing oil shale. After forming each fragmented mass, the final preparation steps for producing liquid and gaseous products from each retort are carried out. These include drilling a plurality of feed gas inlet passages 88 downwardly from the air level void to the top boundary of each fragmented mass so that oxygen supplying gas can be introduced into each fragmented mass during retorting operations. Alternatively at least a portion of the blast holes through the sill pillar are used for introduction of oxygen supplying gas. A separate horizontally extending product withdrawal drift 90 extends away from a lower portion of each fragmented mass at the lower production level, and each product withdrawal drift opens into opposite sides of a main production level drift 92 for removal of liquid and gaseous products from the bottom of the retorts. The product withdrawal drifts are downwardly inclined toward the main production level drift 92 so that liquid products of retorting can flow down toward the main production level drift.

During retorting operations, a combustion zone is established in each fragmented mass, and the combustion zone is advanced downwardly through each fragmented mass by introducing an oxygen supplying gas into the fragmented mass. Combustion gas produced in the combustion zone passes through the fragmented mass to establish a retorting zone on the advancing side of the combustion zone, wherein kerogen in the oil shale is retorted to produce liquid and gaseous products of retorting. The liquid products and an off gas containing gaseous products pass to the bottom of the fragmented mass and are withdrawn to the main production level drift through the separate product withdrawal drifts. Liquid products can flow toward the end of the main production level drift and are collected in a sump (not shown) at the end of the main drift. A pump (not shown) is used to withdraw liquid products from the sump to above ground. Off gas is withdrawn from the production level by a blower (not shown) and passed to above ground.

The fragmented mass in each retort is formed with a generally T-shaped bottom near the production level. Such a T-shaped bottom is best illustrated in the vertical cross-section of the fragmented mass shown in FIG. 5 and in the horizontal cross-section of the fragmented mass shown in FIG. 6 wherein the fragmented formation particles are deleted for clarity of illustration.

The T-shaped bottom is formed by initially excavating the upper and intermediate voids with a horizontal cross-sectional area substantially greater than the horizontal cross-sectional area of the production level void. In one embodiment, the area of the production level void is between about 30% to about b 70% of the area of the upper and intermediate voids.

In the embodiment shown, the production level void does not extend below the two outer bands of lower blast holes 46', 46'' drilled in the upper portion 32' of the lower zone of unfragmented formation. Thus, detonation of explosive charges in these two outer bands of blast holes explosively expands formation only in an upward direction toward the lower free face adjacent the intermediate void. Detonation of explosive in the remaining longer lower blast holes 46 explosively expands formation from the lower zone upwardly and downwardly toward the intermediate void and the production level void, respectively. This forms a fragmented mass having a lower portion with the vertical cross-section shaped generally as a T. In a working embodiment, the cross bar of the T is about 160 feet wide, 160 feet long, formed by explosive expansion of formation within the upper portion 32' of the lower zone of unfragmented formation and upper portions of the retort. The leg of the T is about 100 feet wide, 100 feet long and about 45 to 50 feet high and is formed primarily by explosive expansion of formation within the lower portion 32'' of the lower zone of unfragmented formation downwardly toward the production level void. The cross bar of the T is illustrated at 93 in FIG. 5, and the leg of the T is illustrated at 94 in FIGS. 5 and 6. Thus, in this embodiment the horizontal cross-sectional area of the fragmented mass in the leg of the T about 40% of the horizontal cross-sectional area in upper regions of the fragmented mass. Since the blast holes extending downwardly adjacent the intersection of the cross bar and leg of the T-shaped bottom are of differing length, as described above, the bottom boundary 47 slopes gently toward the leg of the T and the corners of the T-shaped bottom of the fragmented mass are slightly beveled. This provides a somewhat inwardly sloping step at the transition between the 160-foot wide upper portion of the fragmented mass above the production level and the 100-foot wide lower portion of the fragmented mass nearer the production level. The bottom boundary of the retort is stepped with a relatively higher elevation sloping step 47 surrounding the lower level floor of the production level void. The sides of the bottom portion between the floor at the elevation of the production level drift and the elevation of the step extend substantially vertically.

The void volume of the production level void relative to the amount of formation explosively expanded toward the void is substantially greater than the void volume of the intermediate void relative to the amount of formation explosively expanded toward the intermediate void. This results in a higher void fraction in the fragmented mass in the T-shaped bottom than the average void fraction in the balance of the fragmented mass. In the working embodiment, the void fraction of the fragmented mass in the leg of the T is about 35%, whereas the void fraction in higher elevations of the fragmented mass is about 23% to 25%.

The T-shaped bottom of the fragmented mass avoids creating a substantial constriction in the horizontal cross-sectional area of the fragmented mass through which gaseous products of retorting pass near the production level. For example, a much narrower funnel-shaped bottom at the production level of a fragmented mass can produce a large constriction in the horizontal cross-sectional area through which gaseous products of retorting flow as they are being withdrawn from the fragmented mass. Such a large constriction to gas flow in the lower portion of the fragmented mass can increase gas velocities near the production level to as much as 5 to 10 times the gas velocities in upper elevations of the fragmented mass. Such a high gas velocity at the production level can entrain shale oil droplets in the gas being withdrawn from the bottom of the fragmented mass, producing aerosols which are withdrawn in the off gas from the fragmented mass. The T-shaped bottom of the fragmented mass avoids such large increases in gas velocity near the production level. Since the horizontal cross-sectional area of the leg of the T is at least about 30% of the horizontal cross-sectional area in the upper portions of the fragmented mass and the void fraction near the production level is appreciably higher than the void fraction in other portions of the fragmented mass, a substantial constriction at the production level of the fragmented mass is avoided. The T-shaped bottom results in gas velocities in the lower portion of the fragmented mass which are not more than about three times the gas velocity in upper elevations of the fragmented mass. This substantially avoids appreciable amounts of shale oil being withdrawn as an aerosol in the retort off gas.

If the cross-sectional area of the production level void, and hence the fragmented mass in the leg of the T-shaped bottom, is less than about 30% of the cross-sectional area of the fragmented mass in upper parts of the retort, the gas velocity increase due to constriction at the bottom can result in excessive aerosol entrainment in the retort off gas. Preferably, the cross-sectional area of the fragmented mass in the T-shaped bottom is less than about 70% of the cross-sectional area in upper portions of the retort. This area provides ample cross-section for gas flow to minimize aerosol entrainment and excess mining costs are avoided. Access drifts are provided at the elevation of the production level void and hence adjacent the T-shaped bottom. These drifts remain open during the productive life of adjacent retorts and sufficient unfragmented formation is left around the drifts to provide long term stability and resistance to damage during retort formation. If the T-shaped bottom portion has an area greater than about 70% of the horizontal cross-sectional area of upper portions of the retort, insufficient unfragmented formation can remain along the production level drifts.

The T-shaped bottom on the retort also helps minimize combustion zone skewing as a combustion zone advances downwardly through the fragmented mass in the retort. When retorting off gas is withdrawn from an edge at the bottom of an in situ retort, gas flow can be larger near that edge than elsewhere in the fragmented mass and a combustion zone can become skewed. The T-shaped bottom helps distribute gas flow more uniformly across the retort cross-section and minimizes such skewing.

FIG. 7 shows an alternative retort forming technique using a horizontal free face system of symmetrical blasting and horizontally offset pillars. The mining system shown in FIG. 7 also provides a fragmented mass having a T-shaped bottom. In the technique shown in FIG.

7, the fragmented mass being formed is greater in height than the fragmented mass illustrated in FIGS. 1 to 6. The technique illustrated in FIG. 7 includes an air level void 118, a sill pillar 120 below the air level void, an upper zone of unfragmented formation 124 above an upper horizontal void 122, an upper intermediate zone of unfragmented formation 125 above an upper intermediate void 127, a lower intermediate zone 129 of unfragmented formation above a lower intermediate horizontal void 131, and a lower zone 132 of unfragmented formation above a production level void 130. The air level void, the upper void and the upper and lower intermediate voids are similar in horizontal cross-section to the horizontal cross-section of the fragmented mass being formed; and the horizontal cross-sectional area of the production level void 130 is about 30% to about 50% that of the voids above it. The production level void is offset horizontally somewhat when compared with the position of the horizontal void 30 in the retort shown in FIGS. 1 through 6 so that the drift between the retorts has an additional amount of unfragmented formation adjacent the drift for overburden support.

Each support pillar 136 in the upper void 122 is offset horizontally relative to at least a portion of a corresponding pillar 134 located in the air level void immediately above the pillar in the upper void. This provides an open floor space in the air level void for providing access for drilling one or more vertical blast holes 142 downwardly from the air level void through the pillars 136 in the upper void and into the zone 125 of unfragmented formation below the upper void.

Similarly, the central portion of a pillar 137 in the upper intermediate void is located below an open floor space in the upper void between the two pillars 136 in the upper void. This provides an access region in the upper void for drilling one or more blast holes 144 down from the upper void through the pillar 137 in the upper intermediate void and into unfragmented formation in the lower intermediate zone 129 of unfragmented formation.

The lower intermediate void includes a pair of horizontally spaced apart support pillars 139 extending below outer portions of the pillar 137 in the upper intermediate void. An open floor space in the upper intermediate void provides access for drilling one or more lower intermediate blast holes 143 down from the floor of the upper intermediate void through each pillar 139 in the lower intermediate void and into the lower zone 132 of unfragmented formation. An open floor space in the lower intermediate void between the pillars 139 provides access for drilling vertical lower blast holes 146 into the lower zone of unfragmented formation.

The horizontally offset pillars in the mining arrangement illustrated in FIG. 7 are similar to those illustrated in FIGS. 1 to 6, in that vertical blast holes can be drilled down into all regions of unfragmented formation within the retort site from an adjacent overlying excavation, except for those portions of unfragmented formation occluded by the support pillars, in which instances these regions of formation can be reached by vertical blast holes drilled down through only one support pillar from an overlying excavation immediately above the excavation in which such a pillar is located.

The mining arrangement illustrated in FIG. 7 also provides a symmetrical blasting scheme similar to that illustrated in FIGS. 1 to 6. That is, vertical blast holes drilled in the upper zone of unfragmented formation are loaded with columns of explosive 149 extending through the upper half of the upper zone of unfragmented formation. Vertical blast holes drilled in the upper intermediate zone of unfragmented formation are loaded with columns of explosive 145 extending through approximately the middle half of the upper intermediate zone of unfragmented formation. Vertical blast holes drilled through the lower intermediate zone of unfragmented formation are loaded with columns of explosive 149 extending through the middle half of the lower intermediate zone of unfragmented formation.

The lower zone of unfragmented formation has an upper portion 132' of substantially uniform thickness extending across substantially the entire width of the retort being formed. The lower zone also includes a lower portion 132" of substantially uniform thickness which is reduced in width relative to the width of the upper portion 132' of the lower zone. An outer group of the vertical blast holes drilled in the lower zone of unfragmented formation define the lower boundary 147 of the fragmented mass being formed. The lengths of the outer blast holes are progressively longer as the rows of blast holes approach the center of the retort, as illustrated in FIG. 7. This provides a sloping step between a wider upper portion and a narrower leg of a T-shaped bottom of the fragmented mass being formed. An inner group of the vertical blast holes drilled in the lower zone are longer than the outer group of the blast holes. These longer blast holes extend entirely through the upper portion 132' of the lower zone and half way through the lower portion 132" of the lower zone above the production level void 130. The blast holes in the outermost band drilled in the lower zone of unfragmented formation are loaded with explosive charges 174 extending through one half of the depth of the upper portion of the lower zone, and the inner group of the blast holes in the lower zone have explosive charges extending through half of the upper portion 132' plus half of the lower portion 132" of the lower zone. Blast holes in the band or bands between the perimeter band and the inner group of blast holes are drilled and loaded to intermediate depths.

Explosive within the retort site shown in FIG. 7 is explosively expanded in a single round of explosions and in a symmetrical blasting arrangement in which the amount of formation explosively expanded downwardly and upwardly toward the upper, the upper intermediate and the lower intermediate voids is substantially the same, similar to the techniques of symmetrical blasting described for the retort shown in FIGS. 1 through 6.

Explosive expansion of formation in the lower zone of unfragmented formation for the retort of FIG. 7 forms a T-shaped bottom of the fragmented mass similar to that shown for the retort in FIGS. 1 through 6.

In the embodiments hereinabove described, the dimensions of the voids and the zones of unfragmented formation, and blast hole depths are stated with a degree of precision essentially unattainable in practical mining operations. Thus, for example, the depth of blast holes is stated as the desired value, sometimes to one-half foot. Discrepancies of a foot or two in the depth of such blast holes are not unexpected and have an insignificant effect on the formation of a retort.

Likewise, the height of a void or the thickness of a zone of unfragmented formation between adjacent voids can differ from the design value due to practical mining constraints. Preferably a void is excavated with its roof at a stratum that is sufficiently competent to provide safe working conditions in the void during the time period required for forming a retort. A floor level for a void may also be sought where a smooth parting is obtained to ease blasting and loading operations. The result can be deviation from the designed symmetry. Thus, for example, in one practical example of symmetrical explosive expansion of oil shale to form an in situ retort, the volume of oil shale expanded downwardly towards an excavated void was estimated to be about 10% greater than the volume of oil shale expanded upwardly towards that void. Similarly moderate angular deviations can be tolerated in the vertical blast holes since the effects on spacing between blast holes is not great.

FIG. 8 schematically illustrates in vertical cross section a system of underground workings for forming an in situ oil shale retort in accordance with principles of this invention. The in situ retort to be formed is square or rectangular in horizontal cross section having a top boundary 112, four vertically extending side boundaries 114, and a lower boundary 116 at a T-shaped bottom as hereinabove described. A portion of the formation within the retort site is excavated on an upper working level to form an air level void 118. The floor of the air level void is spaced above the upper boundary 112 of the retort being formed, leaving a horizontal sill pillar 120 of unfragmented formation between the floor of the air level void and the upper boundary of the retort being formed.

A rectangular upper void 122 is excavated at a level spaced vertically below the sill, leaving an upper zone 124 of unfragmented formation extending horizontally across the retort site between the upper boundary 112 of the retort being formed and a horizontal upper free face above the upper void.

An intermediate void 126 is excavated at an intermediate level of the retort being formed, leaving an intermediate zone 128 of unfragmented formation extending horizontally across the retort site between a horizontal free face at the floor of the upper void and a horizontal free face at the roof of the intermediate void. The horizontal cross sections of the upper and intermediate voids are similar and the intermediate void is directly below the upper void.

A production level void 130 is excavated at a lower production level of the retort being formed, leaving a lower zone 132 of unfragmented formation extending horizontally across the retort site between a horizontal free face at the floor of the intermediate void and a horizontal free face at the roof of the production level void. The horizontal cross-sectional area of the upper and intermediate voids is substantially greater than the horizontal cross-sectional area of the production level void for forming a T-shaped bottom on the retort.

The air level void includes a pair of laterally spaced apart support pillars 134 for providing support for the unfragmented formation above the air level void. The upper void 122 includes one large support pillar 136 of rectangular horizontal cross section located centrally within the upper void. The intermediate void 126 includes a pair of laterally spaced apart, parallel, relatively long and narrow support pillars 138. The production level void 130 includes a pair of laterally spaced apart, relatively long and narrow, parallel support pillars 140.

The support pillar 136 in the upper void is offset horizontally from the support pillars 134 in the air level void 118. Thus there is an open floor space in the air level void vertically above at least a portion of the pillar 136 in the upper void 122. Likewise there is an open roof space in the upper level void vertically below at least a portion of the air level pillars 134.

Similarly the support pillars 138 in the intermediate void 126 are offset horizontally from the support pillar 136 in the upper void. This leaves an open floor space in the upper void extending directly above at least a portion of the pillars 138 in the intermediate void. Similarly an open roof space is provided in the intermediate void below at least a portion of the pillar 136 in the upper void.

The pillars 140 in the production level void 130 are offset horizontally from the support pillars 138 in the intermediate void.

Because of the offsetting of the pillars in the several voids excavated for forming the in situ retort, access is provided for drilling a square array of blast holes in the intervening zones of unfragmented formation with at least a portion of the blast holes being drilled upwardly from such a void into unfragmented formation occluded by a support pillar which prevents drilling from an immediately overlying void. Thus, a plurality of vertical blast holes 142 are drilled downwardly from the air level void into the upper zone 124 of unfragmented formation between the horizontal sill pillar and the upper void. Some areas in which blast holes are desired are occluded by the pillars 134 in the air level void. Vertical blast holes 142' are therefore drilled upwardly into the upper zone 124 of unfragmented formation from the roof of the upper level void 122. Since the pillar in the upper level void is offset horizontally from the pillars in the air level void, access is provided for drilling vertical blast holes from either the air level void or the upper level void. Some of the blast holes in the square array could be drilled either downwardly or upwardly since access is available from above or below, however, since downward holes are easier to drill and load then upward holes such downward holes are drilled where possible.

In the intermediate zone 128 of unfragmented formation between the upper void and intermediate void 126, a plurality of blast holes 144 are drilled downwardly from the upper level void. At least a portion of these vertical blast holes are vertically above roof support pillars in the intermediate void. In addition some vertical blast holes 144' are drilled upwardly from the roof of the intermediate void. Such blast holes are drilled from an open roof area in the intermediate void vertically below the roof supporting pillars 136 in the upper void.

Similarly, a plurality of vertical blast holes 146 are drilled downwardly into the lowermost zone 132 of unfragmented formation from the intermediate void 126. In those areas occuluded by pillars 138 in the intermediate void, blast holes 146' are drilled upwardly from the production level void 116.

After such blast holes are drilled, explosive is loaded and detonators are placed in a pattern substantially the same as hereinabove described and illustrated in FIGS. 2 to 4. Such explosive is detonated as hereinabove described to form a fragmented permeable mass of particles in the retort.

Embodiments other than those described above can be used without departing from the scope of the invention. A matrix of blast holes can be drilled in other than a symmetrical pattern, such as a rectangular pattern, for example. The number of pillars left in each void also can vary from that shown in the drawings. The shape of the pillars also can vary. For example, one or more pillars can be square instead of rectangular as shown. In some instances, the amount of formation explosively expanded upwardly toward a horizontal void need not be the same as that explosively expanded downwardly toward the same horizontal void. In other instances, the amount of explosive used in each blast holes within a given zone of unfragmented formation can vary from one blast hole to another. Although in one embodiment the effective scaled depth of burial of each half of the explosive columns in a given zone of formation can be equal, in other embodiments the scaled depth of burial can vary. Although another embodiment describes detonators placed at the same level within a zone of formation, in other embodiments such detonators can be placed at varying levels within a given zone of formation. In other instances, explosive within a retort site can be detonated in other than a single round of explosions.

What is claimed is:

1. A method for recovering liquid and gaseous products from an in situ oil shale retort formed in a retort site within a substerranean formation containing oil shale, such as in situ oil shale retort containing a fragmented permeable mass of formation particles containing oil shale, comprising the steps of:

excavating formation from within the retort site for forming an upper void extending horizontally across the retort site, leaving an upper zone of unfragmented formation above the upper void, and leaving at least a first pillar of unfragmented formation within the upper void for providing temporary support for the upper zone of unfragmented formation;

excavating formation from within the retort site for forming a lower void extending horizontally across the retort site, the lower void being spaced immediately below the upper void, leaving an intermediate zone of unfragmented formation extending horizontally across the retort site between the upper and lower voids, leaving a lower zone of unfragmented formation below the lower void, and leaving at least a second pillar of unfragmented formation within the lower void for providing temporary support for the intermediate zone of unfragmented formation, the second pillar being offset horizontally from the first pillar so that at least a portion of a floor of the upper void lies vertically above at least a portion of the second pillar;

placing explosive in the lower zone of unfragmented formation, at least a portion of such explosive being placed in at least one vertical blast hole extending from said portion of the floor of the upper void through the second pillar and into the lower zone of unfragmented formation below the second pillar;

placing explosive in the upper and intermediate zones of unfragmented formation;

detonating such explosive in the upper, intermediate and lower zones of unfragmented formation for explosively expanding formation within such zones toward the upper and lower voids for forming a fragmented permeable mass of formation particles containing oil shale in an in situ oil shale retort;

establishing a retorting zone in an upper portion of the fragmented mass;

introducing a retorting gas into the fragmented mass for sustaining the retorting zone and for advancing the retorting zone through the fragmented mass; and withdrawing liquid and gaseous products of retorting from a lower portion of the fragmented mass on the advancing side of the retorting zone.

2. The method according to claim 1 including placing explosive in the first and second pillars, and detonating the explosive in the pillars for explosively expanding the pillars before explosively expanding the zones of unfragmented formation.

3. The method according to claim 1 including:

drilling an array of vertical blast holes down from the floor of the upper void into the intermediate zone of unfragmented formation, a first group of the blast holes extending into the intermediate zone of unfragmented formation, a second group of the blast holes extending through the intermediate zone of unfragmented formation, through at least one second pillar in the intermediate void, and into the lower zone of unfragmented formation below such second pillar; and placing explosive in the first group of the blast holes for explosively expanding at least a portion of the intermediate zone, and placing explosive in the second group of the blast holes for explosively expanding at least a portion of the intermediate zone and at least a portion of the lower zone.

4. The method according to claim 3 including placing separate first columns of explosive in the first group of the blast holes; placing separate second columns of explosive in the second group of the blast holes, the second columns of explosive being placed in the lower zone of unfragmented formation below such a second pillar; and placing separate third columns of explosive in the second group of the blast holes, said third columns extending between substantially the same elevations in the intermediate zone as the first columns of explosive in the first group of the blast holes.

5. The method according to claim 3 wherein the vertical blast holes drilled down from the floor of the upper void have substantially uniform horizontal spacing; and wherein any portion of the second pillar extending below such a first pillar in the upper void has a horizontal extent less than the spacing between the blast holes.

6. The method according to claim 1 including drilling an array of vertical blast holes down from the floor of the upper void into the intermediate zone of unfragmented formation, the blast holes being substantially equidistantly spaced apart; and wherein any portion of the second pillar extending below such a first pillar in the upper void has a horizontal extent less than the spacing between the blast holes.

7. A method for forming an in situ oil shale retort in a retort site within a subterranean formation containing oil shale, such an in situ oil shale retort containing a fragmented permeable mass of formation particles containing oil shale, comprising the steps of:

excavating formation from within the retort site for forming an upper void extending horizontally across the retort site, leaving at least a first pillar of unfragmented formation within the upper void for providing temporary support for an upper zone of unfragmented formation above the upper void;

excavating formation from within the retort site for forming a lower void extending horizontally across the retort site and spaced directly below the upper void, leaving a first zone of unfragmented formation extending horizontally across the retort site between the upper and lower voids, leaving a second zone of unfragmented formation below the lower void, and leaving at least a second pillar of unfragmented formation within the lower void for providing temporary support for the first zone of unfragmented formation, at least a portion of the second pillar being spaced vertically below at least an access portion of a floor of the upper void;

drilling a plurality of horizontally spaced apart vertical blast holes in the first and second zones of unfragmented formation, the first pillar being offset horizontally relative to the second pillar such that any portion of the first pillar extending over the second pillar has a width not greater than the average spacing between the blast holes;

drilling at least one vertical blast hole from said access portion of the floor of the upper void, through the first zone of unfragmented formation, through the second pillar, and into the second zone of unfragmented formation below the second pillar; and placing explosive in the blast holes and detonating such explosive for explosively expanding unfragmented formation within the retort site toward the upper and lower voids for forming a fragmented permeable mass of formation particles containing oil shale in an in situ oil shale retort.

8. The method according to claim 7 including placing explosive in the blast holes in the first and second zones of unfragmented formation, and detonating such explosive for explosively expanding formation from the first zone upwardly and downwardly toward the upper and lower voids, respectively, and for explosively expanding formation within the second zone upwardly toward the lower void.

9. The method according to claim 7 wherein each vertical blast hole drilled from said access portion in the upper void through the first zone, through the second pillar, and into the second zone below the second pillar contains a first explosive charge in the first zone of unfragmented formation and contains a second explosive charge spaced below the first explosive charge and located within the second zone below the second pillar.

10. The method according to claim 9 wherein a remaining portion of the vertical blast holes are drilled from the floor of the upper void and extend through a portion of the first zone and such vertical blast holes contain separate explosive charges each extending between elevations in the first zone corresponding to said first explosive charges.

11. The method according to claim 10 wherein a remaining portion of the vertical blast holes are drilled from the floor of the lower void and extend through a portion of the second zone and such vertical blast holes contain separate explosive charges each extending between elevations in the second zone corresponding to said second explosive charges.

12. A system of underground workings for forming an in situ oil shale retort in a retort site in a subterranean formation containing oil shale, wherein a portion of unfragmented formation within the retort site is excavated for forming at least a pair of voids within the tort site and a remaining portion of unfragmented formation within the retort site is explosively expanded toward the voids for forming a fragmented permeable mass of formation particles containing oil shale in an in situ oil shale retort, comprising:

a plurality of vertically spaced apart voids formed within the retort site, each void extending horizontally across the retort site;

a zone of unfragmented formation extending horizontally across the retort site below each void; and at least one pillar of unfragmented formation remaining within each void for providing temporary support for a zone of unfragmented formation above each void, at least a portion of such pillars being positioned horizontally within their corresponding voids such that at least a portion of the zone of unfragmented formation below such a pillar is accessible vertically from an open floor space in the void immediately above the void in which such a pillar is located for allowing a blast hole to be drilled downwardly from such an open floor space, through such a pillar, and into the zone of unfragmented formation below such a pillar.

13. A system of underground workings for forming an in situ oil shale retort in a retort site in a subterranean formation containing oil shale, comprising:

an upper void extending horizontally across the retort site at an upper level;

a lower void extending horizontally across the retort site at a lower level, the lower void being directly below the upper void;

an intermediate zone of unfragmented formation between the upper and lower voids;

a lower zone of unfragmented formation below the lower void;

an upper pillar of unfragmented formation in the upper void for providing temporary roof support for unfragmented formation above the upper void;

a lower pillar in the lower void for providing temporary roof support for the intermediate zone of unfragmented formation above the lower void, at least a portion of the upper pillar being offset horizontally from the lower pillar for providing an open floor space in the upper void above at least a portion of the lower pillar;

a plurality of lower blast holes extending from the lower void into the lower zone of unfragmented formation;

a plurality of first upper blast holes extending from the upper void into the intermediate zone of unfragmented formation;

a plurality of second upper blast holes extending from the open floor space of the upper void through the intermediate zone of unfragmented formation, through the lower pillar, and into the lower zone of unfragmented formation; and explosive charges in the lower blast holes and in the first and second upper blast holes for use in explosively expanding formation from the intermediate and lower zones toward the upper and lower voids for forming a fragmented permeable mass of formation particles containing oil shale in an in situ oil shale retort.

14. A system of underground workings for forming a retort according to claim 13 wherein the blast holes are substantially equidistantly spaced apart and wherein any portion of such a lower pillar extending below such an upper pillar has a horizontal extent less than the spacing between the blast holes.

15. A system of underground workings for forming a retort according to claim 13 including:

an air level void spaced directly above the upper void;

an upper zone of unfragmented formation between the air level void and the upper void;

an air level pillar in the air level void providing roof support for unfragmented formation above the air level void, the air level pillar being offset horizontally from at least a portion of the upper pillar for providing an open floor space in the air level void above the upper pillar;

a plurality of first air level blast holes extending from the air level void into the upper zone of unfragmented formation;

a plurality of second air level blast holes extending from said open floor space in the air level void through the upper zone of unfragmented formation, through the upper pillar, and into the intermediate zone of unfragmented formation below the upper pillar; and explosive charges in the first and second air level blast holes.

16. A system of underground workings for forming a retort according to claim 15 wherein the explosive charges in the first air level blast holes are in the upper zone of unfragmented formation, and a portion of the explosive charges in the second air level blast holes are in the upper zone of unfragmented formation and another portion of the explosive charges in the second air level blast holes are in the intermediate zone of unfragmented formation below the upper pillar; wherein the explosive charges in the first upper blast holes are in the intermediate zone of unfragmented formation, and a portion of the explosive charges in the second upper blast holes are in the intermediate zone of unfragmented formation and another portion of the explosive charges in the second upper blast holes are in the lower zone of unfragmented formation below the lower pillar; and wherein the explosive charges in the lower blast holes are in the lower zone of unfragmented formation.

17. A system of underground workings according to claim 13 wherein the explosive charges in the first upper blast holes are in the intermediate zone of unfragmented formation; wherein a portion of the explosive charges in the second upper blast holes are in the intermediate zone of unfragmented formation and another portion of the explosive charges in the second upper blast holes are in the lower zone of unfragmented formation below the lower pillar; and wherein the explosive charges in the lower blast holes are in the lower zone of unfragmented formation.

18. A system of underground working according to claim 17 including an explosive charge in the portion of such a second upper blast hole located in the lower pillar.

19. A method for forming an in situ oil shale retort in a subterranean formation containing oil shale, such an in situ oil shale retort containing a fragmented permeable mass of formation particles containing oil shale, comprising the steps of:

excavating formation from within the retort site for forming a first void extending horizontally across the retort site, leaving at least a first pillar of unfragmented formation within the first void for providing temporary roof support for a zone of unfragmented formation above the first void;

excavating formation from within the retort site for forming a second void extending horizontally across the retort site and spaced directly below the first void, leaving a first zone of unfragmented formation extending horizontally across the retort site between the first and second voids, leaving a second zone of unfragmented formation below the second void, and leaving at least a second pillar of unfragmented formation within the second void for providing temporary roof support for the first zone of unfragmented formation, at least a portion of such a second pillar being spaced vertically below an access portion of the first void;

placing explosive in the first and second zones of unfragmented formation, at least a portion of such explosive being placed in at least one vertical blast hole extending from said access portion of the first void through the first zone of unfragmented formation, through such a second pillar, and into the second zone of unfragmented formation below such a second pillar; and detonating explosive in the first and second zones for explosively expanding formation within such zones toward horizontal free faces provided by the first and second voids for forming a fragmented permeable mass of formation particles containing oil shale in an in situ oil shale retort.

20. The method according to claim 19 including explosively expanding the first and second pillars before explosively expanding formation within the first and second zones.

21. The method according to claim 19 including explosively expanding formation within the first zone upwardly toward the first void and downwardly toward the second void, and explosively expanding formation within the second zone upwardly toward the second void.

22. The method according to claim 19 including drilling an array of horizontally spaced apart vertical blast holes downwardly in the first zone of unfragmented formation from the access portion of the first void, a portion of such blast holes extending through such a second pillar and into the second zone of unfragmented formation, the first pillar being offset horizontally relative to the second pillar such that any portion of the first pillar extending over the second pillar has a width not greater than the average spacing between the blast holes.

23. The method according to claim 22 wherein the horizontal spacing between such blast holes is substantially uniform.

24. In a method for forming an in situ oil shale retort containing a fragmented permeable mass of formation particles containing oil shale, wherein a plurality of vertically spaced apart voids are excavated from within a retort site, leaving a zone of unfragmented formation below each void, and leaving at least one pillar within each void for providing temporary support for unfragmented formation above such a void, the improvement comprising leaving a pillar in a first void offset horizontally from a pillar in a second void directly below the first void so that at least a portion of the zone of unfragmented formation below the second void that is occluded by the pillar in the second void is accessible from an open floor space in the first void.

25. The improvement according to claim 24 including drilling a plurality of short blast holes from the first void into the zone of unfragmented formation between the second void and the first void, and drilling a plurality of long blast holes from the open floor space in the first void through the zone of unfragmented formation between the second and first voids, through the pillar in the second void, and into the zone of unfragmented formation below the second void.

26. The improvement according to claim 25 wherein the long blast holes and the short blast holes are mutually spaced apart horizontally across the retort site; and wherein the horizontal spacing between such blast holes is greater than the horizontal extent of any overlap of the pillar in the first void above the pillar in the second void.

27. The improvement according to claim 25 wherein the long blast holes contain explosive placed in the zone of unfragmented formation between the first and second voids and in the zone of unfragmented formation below the second void.

28. The improvement according to claim 25 including drilling a plurality of second short blast holes from the second void into the zone of unfragmented formation below the second void; and wherein none of the blast holes drilled from within the first void or the second void extend through more than one pillar.

29. A method for forming an in situ oil shale retort in a retort site in a subterranean formation containing oil shale, such as in situ shale retort containing a fragmented permeable mass of formation particles containing oil shale, comprising the steps of:

excavating first and second voids within the retort site, the first void being spaced vertically above the second void, each void extending horizontally across the retort site, leaving first and second zones of unfragmented formation extending across the retort site below the first and second voids, respectively, and leaving a first pillar within the first void and a second pillar within the second void for temporarily supporting unfragmented formation above the first and second voids, respectively;

drilling a plurality of mutually spaced apart vertical blast holes in the first and second zones of unfragmented formation, the blast holes being substantially equidistantly spaced apart horizontally across their corresponding zones of unfragmented formation, a portion of the blast holes in the second zone of unfragmented formation being located in a portion of the second zone of unfragmented formation below the second pillar, the first pillar being offset horizontally relative to the second pillar for providing an open floor space in the first void spaced vertically above the second pillar for providing access for drilling said portion of blast holes located below the second pillar, at least a portion of such blast holes being drilled from the first void through the second pillar, the first pillar being positioned in the first void such that the horizontal extent of any portion of the first pillar located above the second pillar is not greater than the horizontal spacing between adjacent blast holes;

loading explosive into such blast holes; and detonating such explosive for explosively expanding unfragmented formation within the retort site toward the voids for forming a fragmented permeable mass of formation particles containing oil shale in an in situ oil shale retort.

30. The method according to claim 29 wherein none of the blast holes which are drilled in the first and second zones and loaded with explosive extend through more than one pillar.

31. A system of underground workings for forming an in situ oil shale retort in a retort site in a subterranean formation containing oil shale, comprising:

an upper void extending horizontally across the retort site at an upper level;

an intermediate void extending horizontally across the retort site directly below the upper void;

a lower void extending horizontally across the retort site directly below the intermediate void;

an upper zone of unfragmented formation above the upper void;

an upper intermediate zone of unfragmented formation between the upper void and the intermediate void;

a lower intermediate zone of unfragmented formation between the intermediate void and the lower void;

a lower zone of unfragmented formation below the lower void;

at least one upper pillar in the upper void for providing temporary roof support for unfragmented formation above the upper void;

at least one intermediate pillar in the intermediate void for providing temporary roof support for unfragmented formation above the intermediate void, at least a portion of such an upper pillar being offset horizontally from such an intermediate pillar for providing an open floor space in the upper void above at least a portion of the intermediate pillar;

at least one lower pillar in the lower void for providing temporary roof support for unfragmented formation above the lower void, at least a portion of such an intermediate pillar being offset horizontally from such a lower pillar for providing an open floor space in the intermediate void above at least a portion of the lower pillar;

a plurality of first upper blast holes extending from the upper void into the upper intermediate zone of unfragmented formation;

a plurality of second upper blast holes extending from the open floor space of the upper void through the upper intermediate zone, through such an intermediate pillar, and into the lower intermediate zone of unfragmented formation;

a plurality of first intermediate blast holes extending from the intermediate void into the lower intermediate zone of unfragmented formation;

a plurality of second intermediate blast holes extending from the open floor space in the intermediate void through the lower intermediate zone, through such a lower pillar and into the lower zone of unfragmented formation;

a plurality of lower blast holes extending from the lower void into the lower zone of unfragmented formation; and explosive charges in the first and second upper blast holes, in the first and second intermediate blast holes, and in the lower blast holes for use in explosively expanding formation from the zones of unfragmented formation within the retort site toward horizontal free faces provided by the upper, intermediate and lower voids, for forming a fragmented permeable mass of formation particles containing oil shale in an in situ oil shale retort.

32. A system of underground workings according to claim 31 wherein the horizontal spacing between the first and second upper blast holes is greater than the horizontal extent of the open floor space in the upper void directly above such an intermediate pillar; and wherein the horizontal spacing between the first and second intermediate blast holes is greater than the horizontal extent of the floor space in the intermediate void directly above such a lower pillar.

33. A system of underground workings for forming a retort according to claim 32 including:

an air level void spaced directly above the upper void;

the upper zone of unfragmented formation being between the air level void and the upper void;

at least one air level pillar in the air level void providing roof support for unfragmented formation above the air level void, such an air level pillar being offset horizontally from at least a portion of such an upper pillar for providing an open floor space in the air level void above such an upper pillar;

a plurality of first air level blast holes extending from the air level void into the upper zone of unfragmented formation;

a plurality of second air level blast holes extending from said open floor space in the air level void through the upper zone of unfragmented formation, through such an upper pillar, and into the upper intermediate zone of unfragmented formation; and explosive charges in the first and second air level blast holes.

34. A system of underground workings according to claim 33 including an explosive charge in each first air level blast hole within the upper zone; an upper explosive charge in a portion of each second air level blast hole within the upper zone and a lower explosive charge in a portion of each second air level blast hole within the upper intermediate zone; an explosive charge in each first upper blast hole within the upper intermediate zone; an upper explosive charge in a portion of each second upper blast hole within the upper intermediate zone and a lower explosive charge in a portion of each second upper blast hole within the lower intermediate zone; an explosive charge in a portion of each first intermediate blast hole within the lower intermediate zone; an upper explosive charge in each second intermediate blast hole within the lower intermediate zone and a lower explosive charge in a portion of each second intermediate blast hole within the lower zone; and an explosive charge in each lower blast hole within the lower zone.

35. A system of underground workings according to claim 33 including an explosive charge in each first upper blast hole within the upper intermediate zone; an upper explosive charge in a portion of each second upper blast hole within the upper intermediate zone and a lower explosive charge in a portion of each second upper blast hole within the lower intermediate zone; an explosive charge in a portion of each first intermediate blast hole within the lower intermediate zone; an upper explosive charge in a portion of each second intermediate blast hole within the lower intermediate zone and a lower explosive charge in a portion of each second intermediate blast hole within the lower zone; and an explosive charge in each lower blast hole within the lower zone.

36. A system of underground workings according to claim 35 including an explosive charge in at least one second air level blast hole within such an upper pillar; an explosive charge in at least one second upper blast hole within such an intermediate pillar; and an explosive charge in at least one second intermediate blast hole within such a lower pillar.

37. A method for recovering liquid and gaseous products from an in situ oil shale retort formed in a retort site within a subterranean formation containing oil shale, such an in situ oil shale retort containing a fragmented permeable mass of formation particles containing oil shale, comprising the steps of:

excavating formation from within the retort site for forming an upper void extending horizontally across the retort site, leaving an upper zone of unfragmented formation above the upper void, and leaving at least a first pillar of unfragmented formation within the upper void for providing temporary support for the upper zone of unfragmented formation;

excavating formation from within the retort site for forming a lower void extending horizontally across the retort site, the lower void being spaced immediately below the upper void, leaving an intermediate zone of unfragmented formation extending horizontally across the retort site between the upper and lower voids, and leaving at least a second pillar of unfragmented formation within the lower void for providing temporary support for the intermediate zone of unfragmented formation, the second pillar being offset horizontally from the first pillar so that at least a portion of the floor of the upper void lies vertically above at least a portion of the second pillar, and at least a portion of the roof of the lower void lies vertically below at least a portion of the first pillar;

drilling a plurality of vertical blast holes downwardly from the floor of the upper void including at least one blast hole vertically above the second pillar;

drilling at least one vertical blast hole upwardly from the roof of the lower void vertically below the first pillar;

placing explosive in such blast holes;

detonating such explosive in the intermediate zone of unfragmented formation for explosively expanding formation within such zone toward the upper and lower voids for forming a fragmented permeable mass of formation particles containing oil shale in an in situ oil shale retort;

establishing a retorting zone in an upper portion of the fragmented mass;

introducing a retorting gas into the fragmented mass for sustaining the retorting zone and for advancing the retorting zone through the fragmented mass; and withdrawing liquid and gaseous products of retorting from a lower portion of the fragmented mass on the advancing side of the retorting zone.

38. The method according to claim 37 including placing explosive in the first and second pillars, and detonating the explosive in the pillars for explosively expanding the pillars before explosively expanding the zone of unfragmented formation.

39. The method according to claim 37 wherein the vertical blast holes drilled down from the floor of the upper void have substantially uniform horizontal spacing; and wherein any portion of the second pillar extending below such a pillar in the upper void has a horizontal extent less than the spacing between the blast holes.

40. A method for forming an in situ oil shale retort in a subterranean formation containing oil shale, such an in situ oil shale retort containing a fragmented permeable mass of formation particles containing oil shale, comprising the steps of:

excavating formation from within the retort site for forming an upper void extending horizontally across the retort site, leaving at least a first pillar of unfragmented formation within the upper void for providing temporary support for an upper zone of unfragmented formation above the upper void;

excavating formation from within the retort site for forming a lower void extending horizontally across the retort site and spaced directly below the upper void, leaving an intermediate zone of unfragmented formation extending horizontally across the retort site between the upper and lower voids, and leaving at least a second pillar of unfragmented formation within the lower void for providing temporary support for the intermediate zone of unfragmented formation;

drilling a plurality of horizontally spaced apart vertical blast holes in the intermediate zone of unfragmented formation, the first pillar being offset horizontally relative to the second pillar such that any portion of the first pillar extending over the second pillar has a width not greater than the average spacing between the blast holes, at least a portion of the blast holes below the first pillar being drilled upwardly from the lower void and at least a portion of the blast holes above the second pillar being drilled downwardly from the upper void; and placing explosive in the blast holes and detonating such explosive for explosively expanding unfragmented formation within the retort site toward the upper and lower voids for forming a fragmented permeable mass of formation particles containing oil shale in an in situ oil shale retort.

41. A system of underground workings for forming an in situ oil shale retort in a retort site in a subterranean formation containing oil shale, comprising:

an upper void extending horizontally across the retort site at an upper level;

a lower void extending horizontally across the retort site at a lower level, the lower void being directly below the upper void;

an intermediate zone of unfragmented formation between the upper and lower voids;

an upper pillar of unfragmented formation in the upper void for providing temporary roof support for unfragmented formation above the upper void;

a lower pillar in the lower void for providing temporary roof support for the intermediate zone of unfragmented formation above the lower void, at least a portion of the upper pillar being offset horizontally from the lower pillar for providing an open floor space in the upper void above at least a portion of the lower pillar, and an open roof space in the lower void below at least a portion of the upper pillar; and a plurality of blast holes extending upwardly from the open roof space in the lower void into the intermediate zone of unfragmented formation below the upper pillar;

a plurality of blast holes extending downwardly from the open floor space upper void into the intermediate zone of unfragmented formation above at least a portion of the lower pillar.

42. A system of underground workings for forming a retort according to claim 41 wherein the horizontal spacing between the blast holes is less than the horizontal extent of the open floor space in the upper void above the lower pillar and less than the horizontal extent of the open roof space in the lower void below the upper pillar.

43. A system of underground workings for forming a retort according to claim 41 including:

an air level void spaced directly above the upper void;

an upper zone of unfragmented formation between the air level void and the upper void;

an air level pillar in the air level void providing roof support for unfragmented formation above the air level void, the air level pillar being offset horizontally from at least a portion of the upper pillar a plurality of air level blast holes extending vertically downwardly from the air level void into the upper zone of unfragmented formation above the upper level pillar; and a plurality of upper blast holes extending vertically upwardly from the upper level void into the upper zone of unfragmented formation below the air level pillar.

44. In a method for forming an in situ oil shale retort containing a fragmented permeable mass of formation particles containing oil shale, wherein a plurality of vertically spaced apart voids are excavated from within a retort site, leaving a zone of unfragmented formation between a pair of such voids, and leaving at least one pillar within each such void for providing temporary support for unfragmented formation above such void, the improvement comprising leaving a pillar in a first void offset horizontally from a pillar in a second void directly below the first void so that at least a portion of said zone of unfragmented formation that is occluded by the pillar in the second void is accessible from an open floor space in the first void and at least a portion of said zone of unfragmented formation that is occluded by the pillar in the first void is accessible from an open roof space in the second void.

45. The improvement according to claim 44 including drilling a plurality of vertical blast holes upwardly from the open roof space of the second void into the zone of unfragmented formation between the second void and the first void, and drilling a plurality of vertical blast holes downwardly from the open floor space in the first void into the zone of unfragmented formation between the second and first voids.

46. The improvement according to claim 44 wherein said blast holes are mutually spaced apart horizontally in a square array across the retort site; and wherein the average horizontal spacing between such blast holes is greater than the horizontal extent of any portion of the pillar in the first void above the pillar in the second void.

47. A method for forming an in situ oil shale retort in a retort site within a subterranean formation containing oil shale, such an in situ oil shale retort containing a fragmented permeable mass of formation particles containing oil shale, comprising the steps of:

excavating formation from within the retort site for forming at least one void extending horizontally across the retort site, leaving a zone of unfragmented formation above such a void and a zone of unfragmented formation below such a void, and leaving at least one pillar of unfragmented formation within the void for providing temporary support for the zone of unfragmented formation above the void;

drilling a plurality of horizontally spaced apart vertical blastholes through at least one of the zones of unfragmented formation and into such a pillar;

placing explosive into the blastholes; and detonating the explosive for explosively expanding the pillar toward the void and for explosively expanding such a zone of unfragmented formation toward the void for forming a fragmented permeable mass of formation particles containing oil shale in an in situ oil shale retort.

48. The method according to claim 47 comprising detonating the explosive in a single round to first explosively expand the pillar toward the void and thereafter to explosively expand such a zone of unfragmented formation toward the void.

49. The method according to claim 47 comprising drilling the horizontally spaced apart vertical blastholes downwardly through the zone of unfragmented formation above the void and into the pillar.

50. The method according to claim 47 comprising drilling the horizontally spaced apart vertical blastholes downwardly through the zone of unfragmented formation above the void, through the pillar, and into the zone of unfragmented formation below the pillar.

51. The method according to claim 47 or 50 comprising detonating the explosive for explosively expanding the pillar toward the void and for explosively expanding the zone of unfragmented formation above the void toward the void and the zone of unfragmented formation below the void toward the void to form a fragmented permeable mass of formation particles containing oil shale in an in situ oil shale retort.

52. A system of underground workings for forming an in situ oil shale retort in a retort site within a subterranean formation containing oil shale, comprising:

at least one void extending horizontally across the retort site;

a zone of unfragmented formation above such a void and a zone of unfragmented formation below such a void;

at least one pillar of unfragmented formation within such a void;

at least one substantially vertical blasthole extending through at least one of the zones of unfragmented formation and into such a pillar;

an explosive charge in such a substantially vertical blasthole within the pillar; and an explosive charge within such a zone of unfragmented formation.

53. A system of underground workings for forming an in situ oil shale retort according to claim 52 wherein such a substantially vertical blasthole extends through the zone of unfragmented formation above the void and into the pillar.

54. A system of underground workings for forming an in situ oil shale retort according to claim 52 wherein such a substantially vertical blasthole extends through the zone of unfragmented formation above the void, through the pillar, and into the zone of unfragmented formation below the void.

55. A system of underground workings for forming an in situ oil shale retort according to claim 52 comprising explosive charges in such a blasthole within the zone of unfragmented formation above the void, within the pillar, and within the zone of unfragmented formation below the void.

56. A method for forming an in situ oil shale retort in a retort site within a subterranean formation containing oil shale, such an in situ oil shale retort containing a fragmented permeable mass of formation particles containing oil shale, comprising the steps of:

excavating formation from within the retort site for forming an upper void extending horizontally across the retort site, leaving an upper zone of unfragmented formation above the upper void;

excavating formation from within the retort site for forming a lower void extending horizontally across the retort site, the lower void being spaced immediately below the upper void, leaving an intermediate zone of unfragmented formation extending horizontally across the retort site between the upper void and the lower void, leaving a lower zone of unfragmented formation below the lower void, and leaving at least one pillar of unfragmented formation within the lower void for providing temporary support for the intermediate zone of unfragmented formation;

drilling a plurality of horizontally spaced apart vertical blastholes from the upper void through the intermediate zone of unfragmented formation and into such a pillar;

placing explosive into the blastholes; and detonating the explosive for explosively expanding the pillar toward the lower void and for explosively expanding the intermediate zone of unfragmented formation toward at least the lower void for forming a fragmented permeable mass of formation particles containing oil shale in an in situ oil shale retort.

57. The method according to claim 56 comprising drilling the plurality of horizontally spaced apart vertical blastholes from the upper void through the intermediate zone of unfragmented formation, through the pillar, and into the lower zone of unfragmented formation.

58. The method according to claim 57 comprising detonating the explosive for explosively expanding the pillar toward the lower void and for explosively expanding the intermediate zone of unfragmented formation toward the lower void and the lower zone of unfragmented formation toward the lower void for forming a fragmented permeable mass of formation particles containing oil shale in an in situ oil shale retort.

* * * * *

UNITED STATES PATENT AND TRADEMARK OFFICE

CERTIFICATE OF CORRECTION

PATENT NO. : 4,296,968

DATED : October 27, 1981

INVENTOR(S) : Thomas E. Ricketts, Ned M. Hutchins, Irving G. Studebaker

It is certified that error appears in the above—identified patent and that said Letters Patent is hereby corrected as shown below:

Column 3, line 9, "pillar" (first occurrence) should be deleted;
Column 3, line 37, "a" before "portion" should be deleted;
Column 3, line 64, "to" (second occurrence) should be deleted.
Column 4, line 11, "a" should be -- an --.
Column 8, line 2, "strated" should be deleted.
Column 17, line 25, -- of explosive charges in -- should be inserted after "Detonation" and before "the".
Column 19, line 8, delete "b" after "about" and before "70%";
Column 19, line 37, -- is -- should be inserted before "about".
Column 24, line 40, "then" should be -- than --;
Column 24, line 55, "occuluded" should be -- occluded --.
Column 25, line 8, "holes" should be -- hole --.
Column 27, line 65, "tort" should be -- retort --.
Column 29, line 51, "working" should be -- workings --.

Signed and Sealed this

*Sixteenth* Day of *February 1982*

[SEAL]

*Attest:*

GERALD J. MOSSINGHOFF

*Attesting Officer*

*Commissioner of Patents and Trademarks*